US011060308B2

(12) United States Patent
Dickey et al.

(10) Patent No.: US 11,060,308 B2
(45) Date of Patent: Jul. 13, 2021

(54) PORTABLE STAGE SYSTEM

(71) Applicant: Sico Incorporated, Edina, MN (US)

(72) Inventors: Christopher C Dickey, West St. Paul, MN (US); Joseph A Bures, Minneapolis, MN (US); Paul Goudreau, Edina, MN (US); Ian Forte, Crystal, MN (US); Andrew Smith, Brooklyn Center, MN (US)

(73) Assignee: Sico, Incorporated, Edina, MN (US)

( * ) Notice: Subject to any disclaimer, the term of this patent is extended or adjusted under 35 U.S.C. 154(b) by 0 days.

(21) Appl. No.: 16/003,703

(22) Filed: Jun. 8, 2018

(65) Prior Publication Data

US 2018/0355629 A1 Dec. 13, 2018

Related U.S. Application Data

(60) Provisional application No. 62/517,249, filed on Jun. 9, 2017.

(51) Int. Cl.
*E04H 3/26* (2006.01)
*E04H 3/28* (2006.01)

(52) U.S. Cl.
CPC ..... *E04H 3/28* (2013.01); *E04H 3/26* (2013.01)

(58) Field of Classification Search
None
See application file for complete search history.

(56) References Cited

U.S. PATENT DOCUMENTS 3,181,203 A * 5/1965 Wenger ..... E04B 1/34336 52/6
3,777,434 A * 12/1973 Selden ..... F16B 7/0493 52/28
4,026,221 A 5/1977 Wilson et al.
4,054,096 A 10/1977 Wilson et al.
4,136,622 A 1/1979 Bue et al.
4,296,573 A 10/1981 Wilson
(Continued)

FOREIGN PATENT DOCUMENTS

EP 0464330 1/1992
WO 0208546 1/2002
WO 2015065200 5/2015

OTHER PUBLICATIONS

International Search Report in corresponding PCT/US2018/036735 dated Sep. 25, 2018.

*Primary Examiner* — Basil S Katcheves
(74) *Attorney, Agent, or Firm* — Merchant & Gould, P.C.

(57) ABSTRACT

A portable stage includes a folding framework supporting a removable deck. The framework includes opposing folding end framework assemblies and opposed side framework assemblies. The framework folds from an extended position for use and a folded positon wherein the framework is compact for storage. The side framework assemblies each include corner columns connected by angled portions having a V configuration forming an open space below the deck. The decks connect with pin connectors that extend into through holes in the deck. The pin connectors having a threaded connector supporting a pin that provides for relative axial movement when the pin is rotated from above to adjust stage height. Removable guardrails include mounting brackets that attach to the pin connectors.

15 Claims, 39 Drawing Sheets

(56) References Cited

U.S. PATENT DOCUMENTS

| | | | | |
|---|---|---|---|---|
| 4,301,627 | A | 11/1981 | Wilson | |
| 4,327,650 | A | 5/1982 | Bue | |
| 4,949,649 | A | 8/1990 | Terres et al. | |
| 4,979,340 | A | 12/1990 | Wilson et al. | |
| 5,317,842 | A | 6/1994 | Rogers et al. | |
| 5,323,563 | A | 6/1994 | Rogers et al. | |
| 5,323,564 | A * | 6/1994 | Mensching | A63J 1/02 52/127.9 |
| 5,325,640 | A * | 7/1994 | Luedke | E04H 3/126 52/9 |
| 5,349,789 | A | 9/1994 | Andert et al. | |
| 5,613,450 | A * | 3/1997 | Wagner | E04H 3/28 108/170 |
| 5,615,451 | A | 4/1997 | Peterson et al. | |
| 5,660,121 | A | 8/1997 | Botts et al. | |
| 5,701,703 | A | 12/1997 | Luedke et al. | |
| 6,024,026 | A | 2/2000 | Botts et al. | |
| 6,070,367 | A | 6/2000 | Wagner et al. | |
| 6,082,051 | A | 7/2000 | Burton et al. | |
| 6,106,186 | A * | 8/2000 | Taipale | E04F 11/002 403/170 |
| 6,164,016 | A | 12/2000 | Bue et al. | |
| 6,164,017 | A | 12/2000 | Burton | |
| 2004/0020154 | A1 * | 2/2004 | Greschbach | E04H 3/12 52/582.1 |
| 2013/0019539 | A1 | 1/2013 | Gardner | |

* cited by examiner

PORTABLE STAGE SYSTEM

BACKGROUND OF THE INVENTION

Field of the Invention

The present invention is directed to a portable stage system and in particular to a modular stage system in which height adjustments are made from above the stage decks, guardrails are mounted to pin connector assemblies and a folding framework allows access to the space below the stage decks.

Description of the Prior Art

Portable stages are utilized for creating a temporary raised stage surface. Generally, rectangular stages may be joined in an edge-to-edge relationship. Such stages may have adjustable frames or legs that provide height adjustment so that the stages may be combined to create extended stage surfaces and may be combined with stages of different heights to form riser-type structures. The stages may also support bridging decks between them. Such portable stages are portable and preferably may be disassembled or fold for compact storage.

Examples of portable stage systems are shown in U.S. Pat. Nos. 4,843,792, 5,050,353, 5,317,842 and 5,323,563. Such stages still have drawbacks that affect their utility.

The staging systems of the prior art typically have folding frameworks to support removable decks. However, the frameworks are generally configured as a lattice type framework with cross supports at the sides of the frames and folding portions at the ends. It may be necessary to access the space below the stage decks for storage, to route cables and other elements for different applications. The frameworks of the prior art portable staging systems have not provided sufficient access to the area below the deck. Therefore, the utility of the portable stages, especially for configurations with a large extended surface, is diminished.

It can also be appreciated that although stage systems may be set up on a smooth level surface, the legs may be out of adjustment or the surface upon which the stage is set up may not be flat and level. This may affect the upper surface of the decks and may cause there to be irregularities so that a planar horizontal surface is not achieved. The irregularities may be a tripping hazard or may cause certain stages and/or decks to wobble when users walk upon the stages. Prior art systems have required that adjustments are made by changing the position of the leg or bottom caster depending on the configuration of the stage. Such adjustments are made near the floor or at least below the stage decking. However, access to the elements that require adjustment are difficult and access is especially difficult when a large extended stage surface is formed and access is needed below a stage that is not near the outer edge of the stage surface.

A further problem with portable stage systems is the difficulties in mounting guardrails at edges of the staging. Portable systems have utilized the stage decks themselves for mounting guardrails. However, the strength of the connection and the relative points of rotation may not be as strong as if a connection could be made to portions of the framework or attached to elements supporting the stage decks. Moreover, the strength of the decks may not be as great as other frame elements and the guardrails may damage the decks.

It can be seen then that a new and improved staging system is required. Such a system should provide for a foldable framework that provides sufficient support and allows greater access to the areas below the stage deck. Such systems should also provide for adjusting the height of the stage surface and making the height adjustment by accessing the adjustment device from the top of the deck surface. Portable stage systems should include improved mounting of guardrails to the support assembly rather than directly to the stage decks. The present invention addresses these as well as other problems associated with portable stages.

SUMMARY OF THE INVENTION

The present invention is directed to a portable stage system and in particular to a portable stage system with removable decks and a foldable framework that provides access to the space beneath the stage, provides adjustment of the height of the stage decks from the above the stage, and provides for mounting guardrails to a portion of the framework assembly.

The portable stage system includes a portable foldable framework that supports one or more stage decks. In one embodiment, the framework supports a single removable, rectangular stage deck while in other embodiments; the foldable framework supports two, three or more removable stage decks. It can be appreciated that the single deck, double deck and/or triple deck portable stage assemblies may be combined and mixed and matched with different numbers of other portable stage assemblies to achieve an extended stage surface having variable multiple sizes and configurations. Moreover, the stages include frameworks that are adapted to support bridging decks between the frameworks to achieve an extended stage surface.

The folding framework includes side sections and folding end sections. The folding end sections include two elements that fold inward and allow the side sections to be moved toward one another for storage. The elements of the end sections are hingedly connected together and include a spring loaded pin to maintain the sections and the framework in the unfolded use configuration. The side framework sections include a horizontal member and two angled portions that extend from an upper portion of a corner column downward to the middle of the horizontal framework member. In one embodiment, the angled portions are formed as a single element, but the framework may be made of two separate frame elements attaching to the horizontal member. This configuration provides sufficient support while allowing greater access as the framework maintains an open space above the angled members. The framework is mounted on casters that may be engaged for transport or disengaged when the stage is in the unfolded use configuration.

The stage decks mount to pin type connectors through through holes near each corner of a deck. The frameworks include columns near the corner of each deck that include telescoping elements that may be extended upward to adjust the height.

Pin type connectors include up to four pins to also support bridging decks and form an extended stage surface with a fewer number of frameworks. The pin type connectors may be mounted in several orientations extending in four directions at each corner so that the pins are positioned below deck if the connector is at a corner of the extended stage surface, with a single pin positioned beyond the edge of the deck if along the side of the stage surface or with all pins extending outward if at an inner portion of the stage surface to support three bridging decks.

The pin connector may also include a height adjustment system that mounts to the top of the telescoping portion of the corner columns. The height adjustment assembly includes a bushing configured to mount in the telescoping portion, a rod threadably connected to the bushing and also connected to a pin and a socket that receives the pin connector housing. The pin of the height adjustment assembly extends through a through hole in the deck and includes a hex or other receiving portion to engage a complementary tool to rotate the pin and the rod. As the rod rotates relative to the bushing, the socket is moved axially relative to the bushing. This rotation changes the height of the assembly and therefore the height of the supported deck. As the adjustment is made by accessing the top of the pin in the height adjustment assembly, height adjustments and leveling may be conducted by workers above the stage surface rather than having to access height adjustments mechanisms near the ground or below the decks.

The portable stage system includes removable guardrails that mount to the pin connector assembly when attached to the frame. The guardrails include mounting brackets mounted at the lower end of the guardrail supports. The bracket is configured for engaging a mounting surface on the pin connector housing that is aligned to maintain the guardrails in a parallel configuration to an edge of the stage deck. The bracket engages the mounting surfaces and also fits over one of the pin-type connectors to securely retain the guardrail in the correct position and with sufficient support and rigidity.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
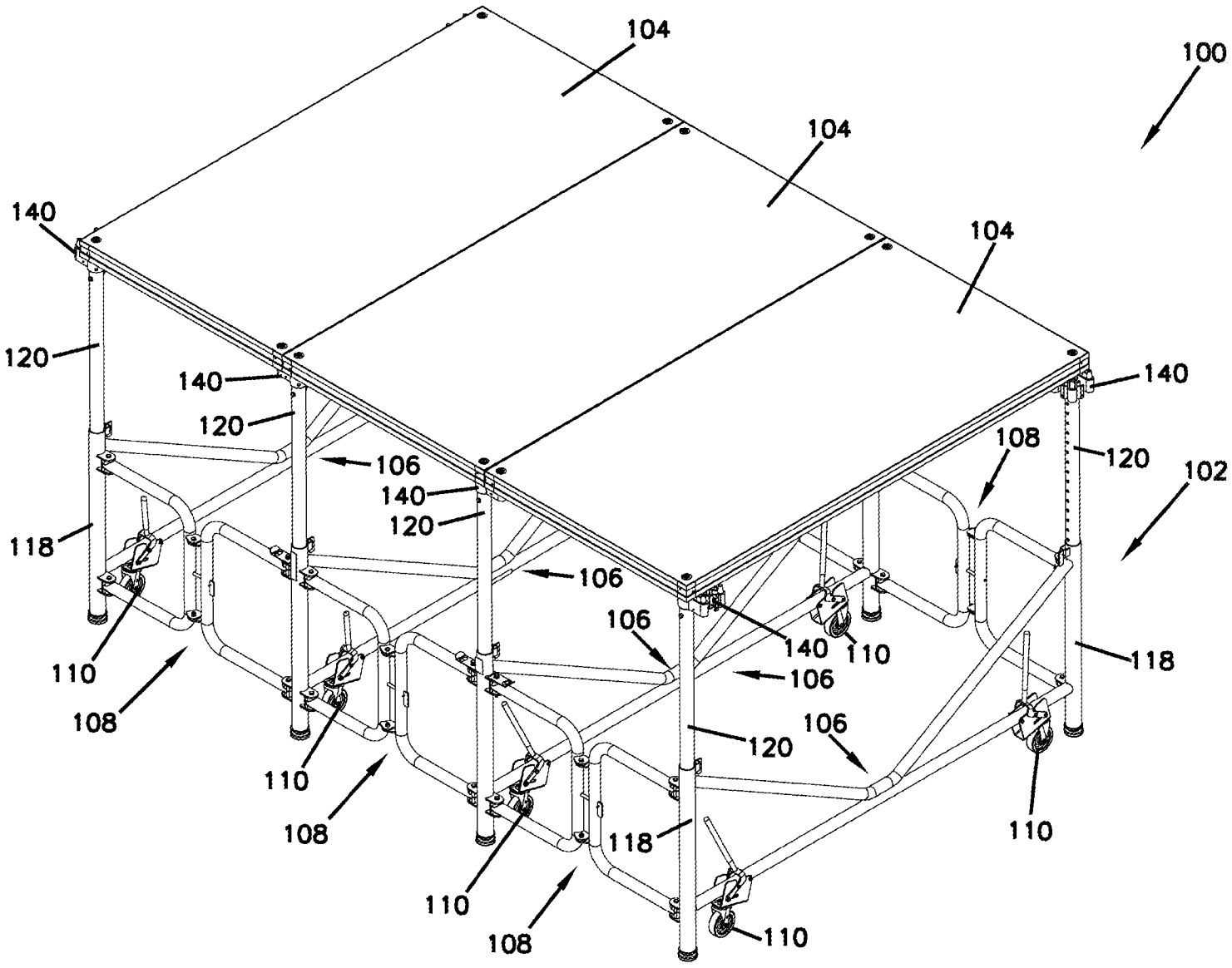
FIG. 1 is a perspective view of a first embodiment of a portable stage in an unfolded position according to the principles of the present invention.
Figure 2:
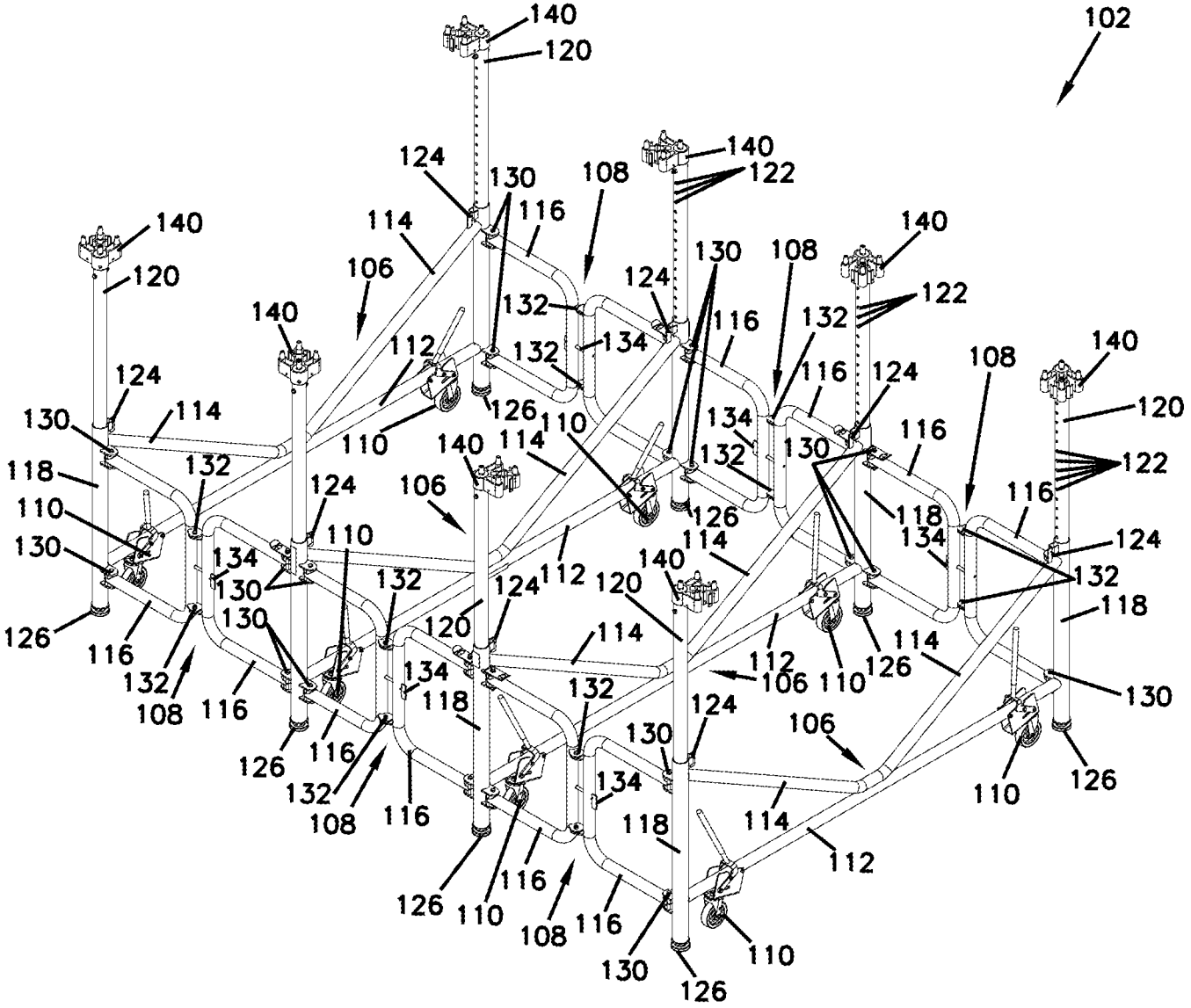
FIG. 2 is a perspective view of the portable stage shown in FIG. 1 with the decks removed.
Figure 3:
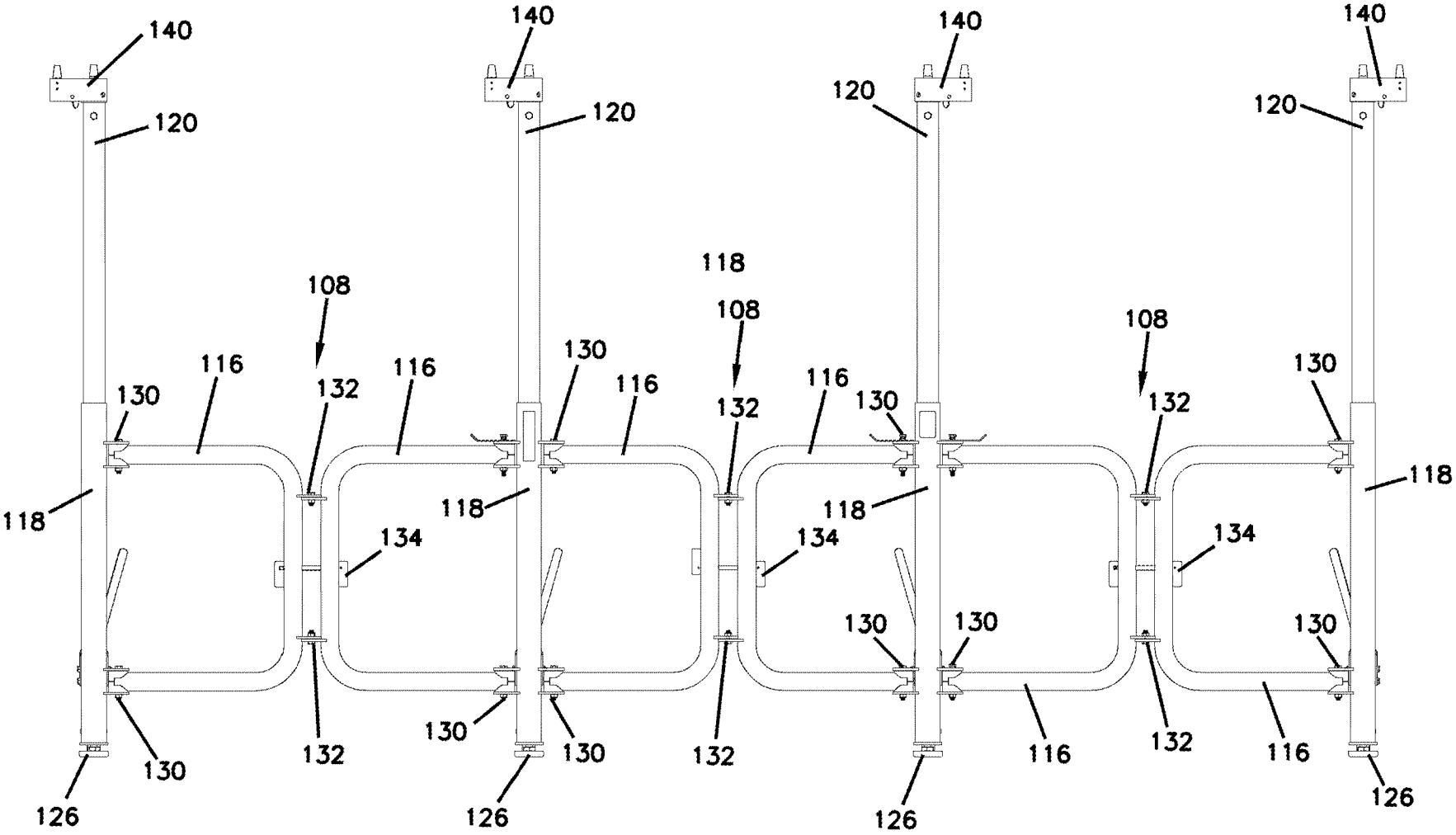
FIG. 3 is an end elevational view of the portable stage shown in FIG. 2.
Figure 4:
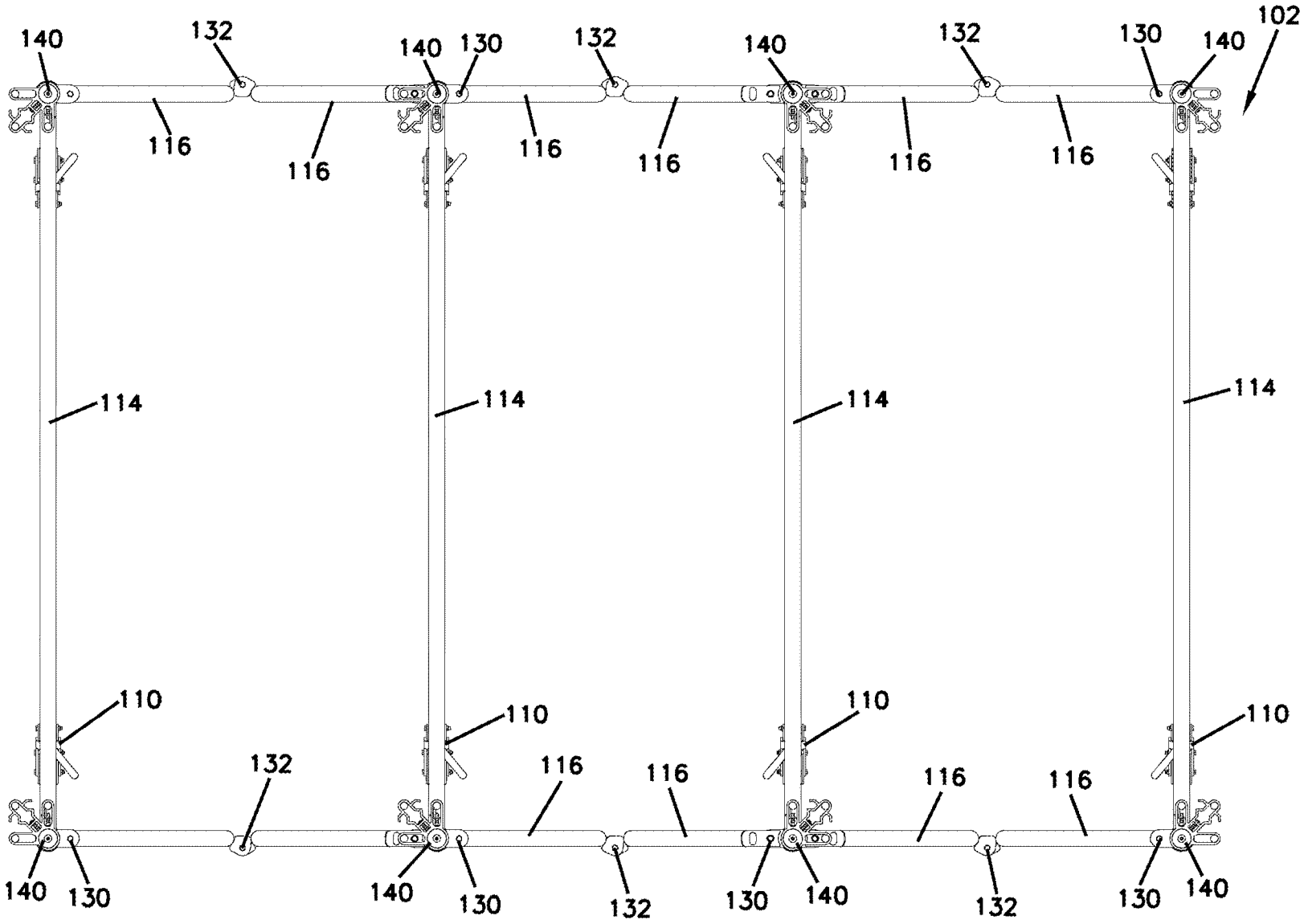
FIG. 4 is a top plan view of the portable stage shown in FIG. 2.
Figure 5:
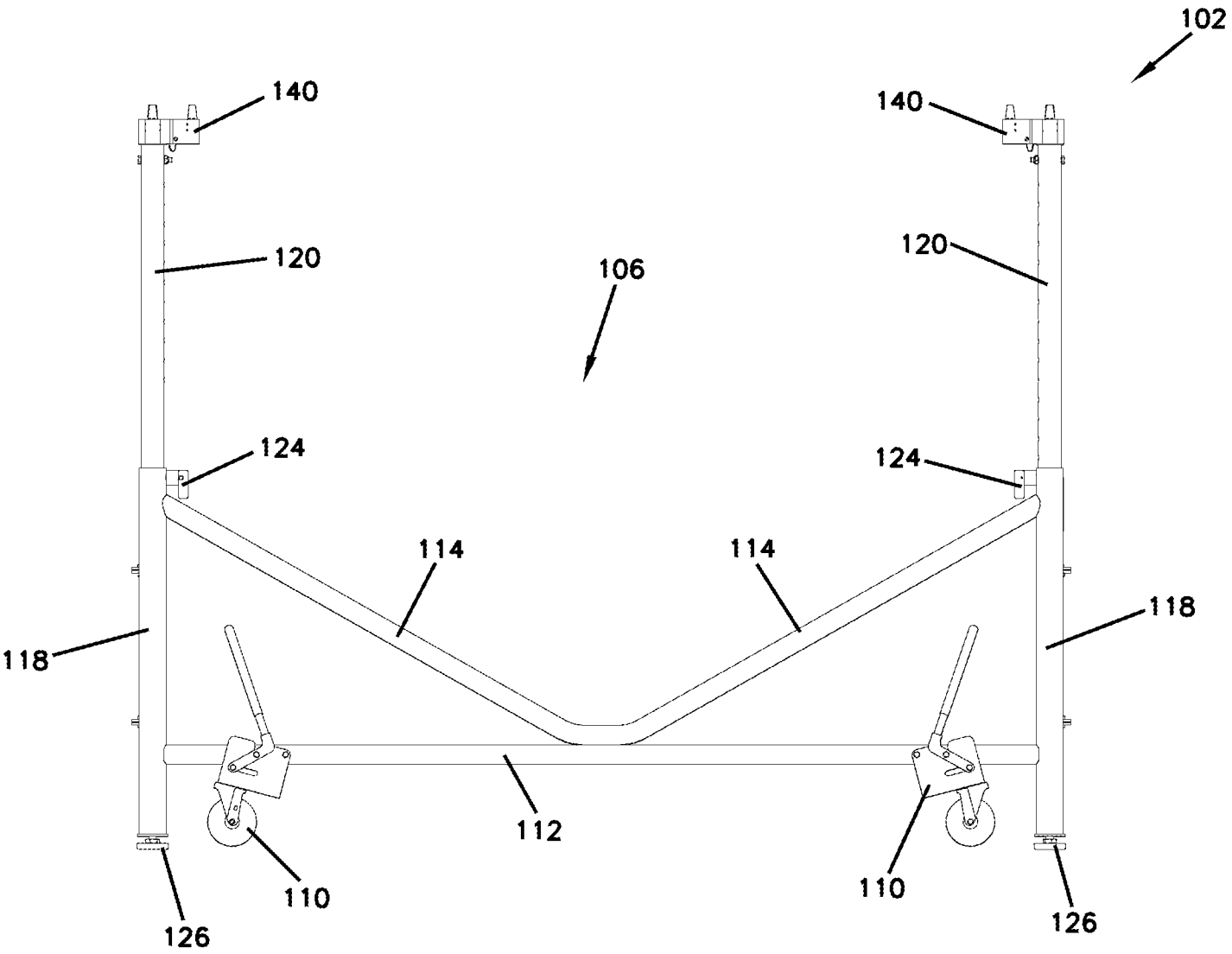
FIG. 5 is a side view of the portable stage shown in FIG. 2.
Figure 6:
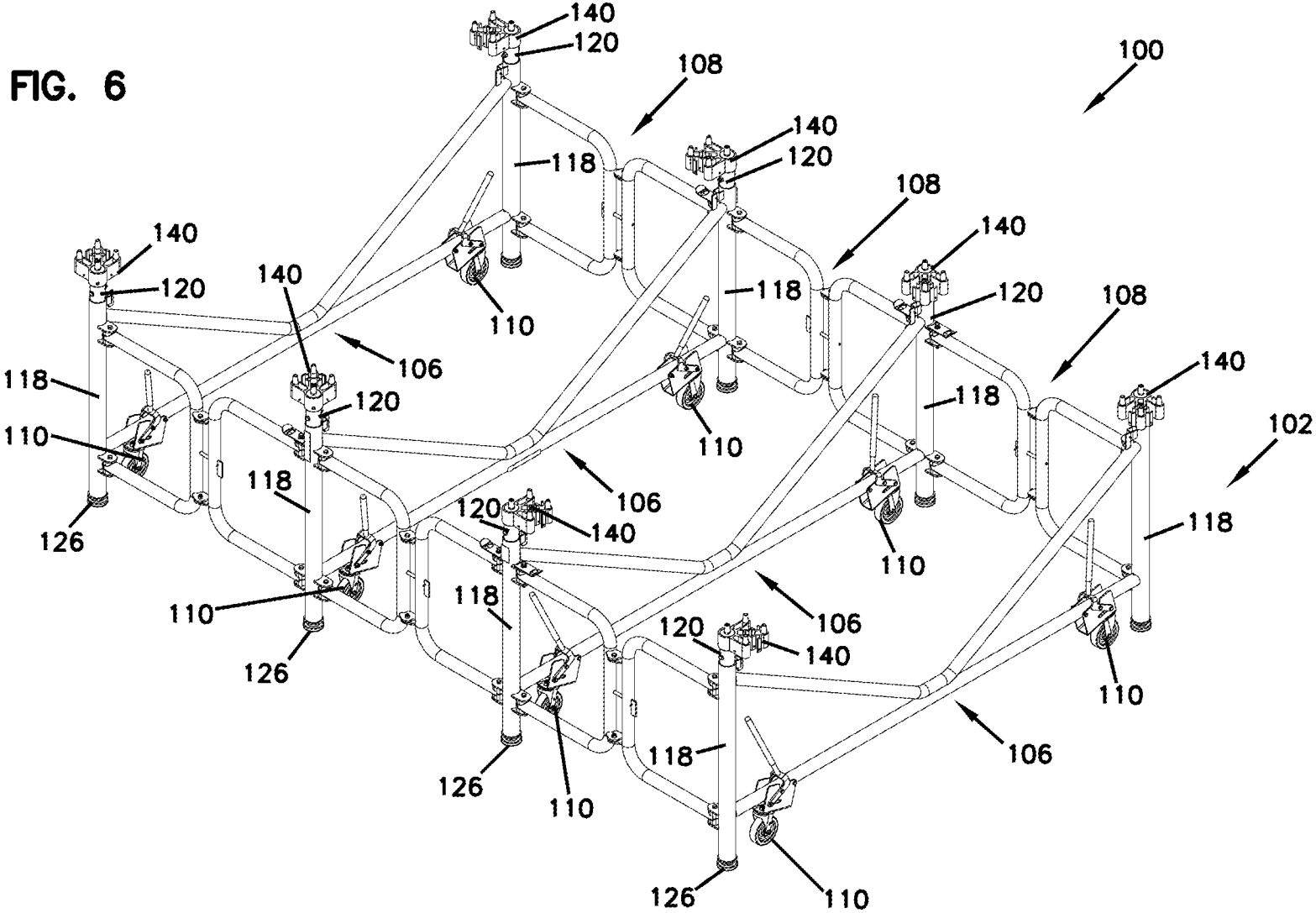
FIG. 6 is a perspective view of the portable stage shown in FIG. 2 with the deck support columns at a lowest position.
Figure 7:
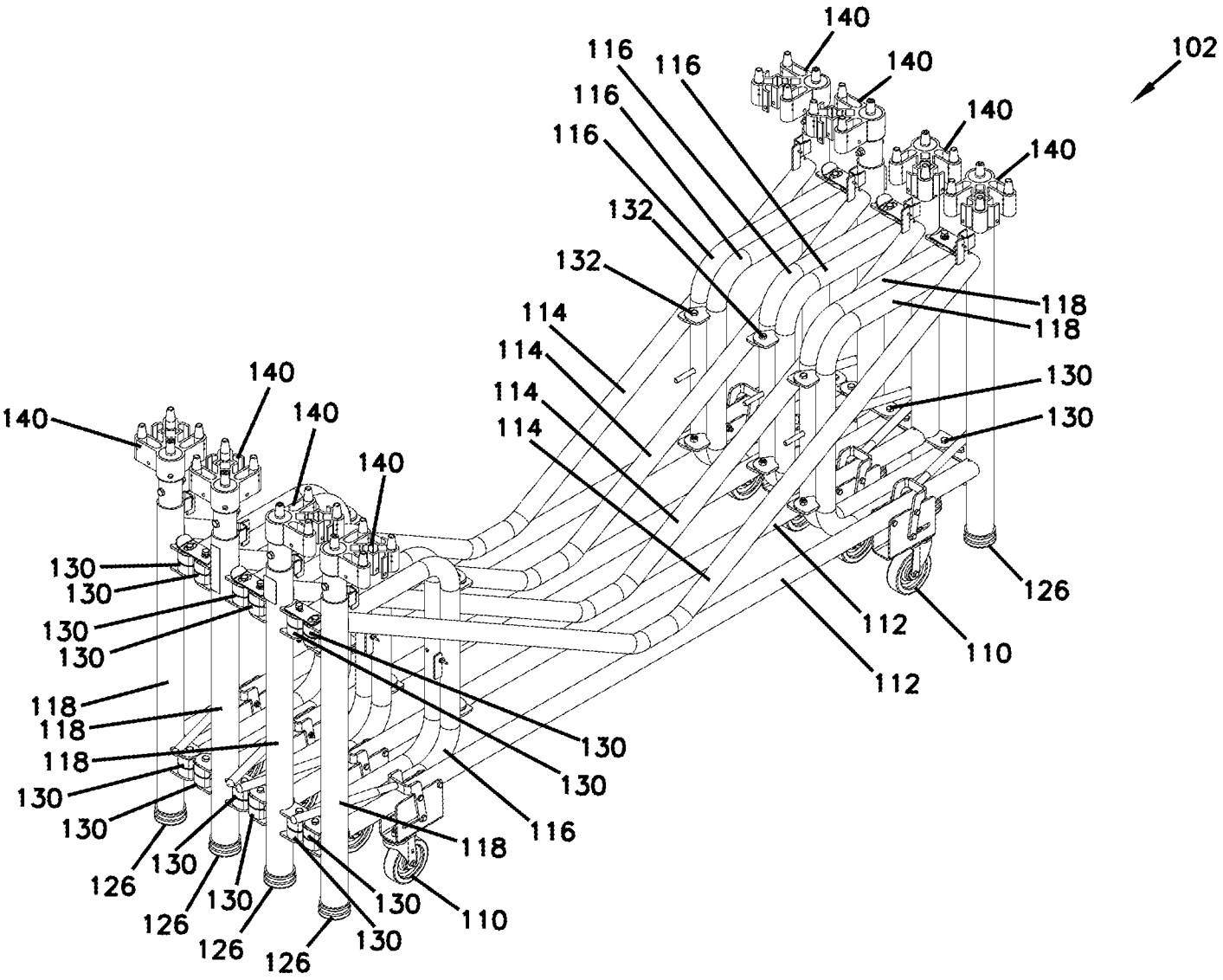
FIG. 7 is a perspective view of the portable stage age shown in FIG. 6 in a folded position.
Figure 8:
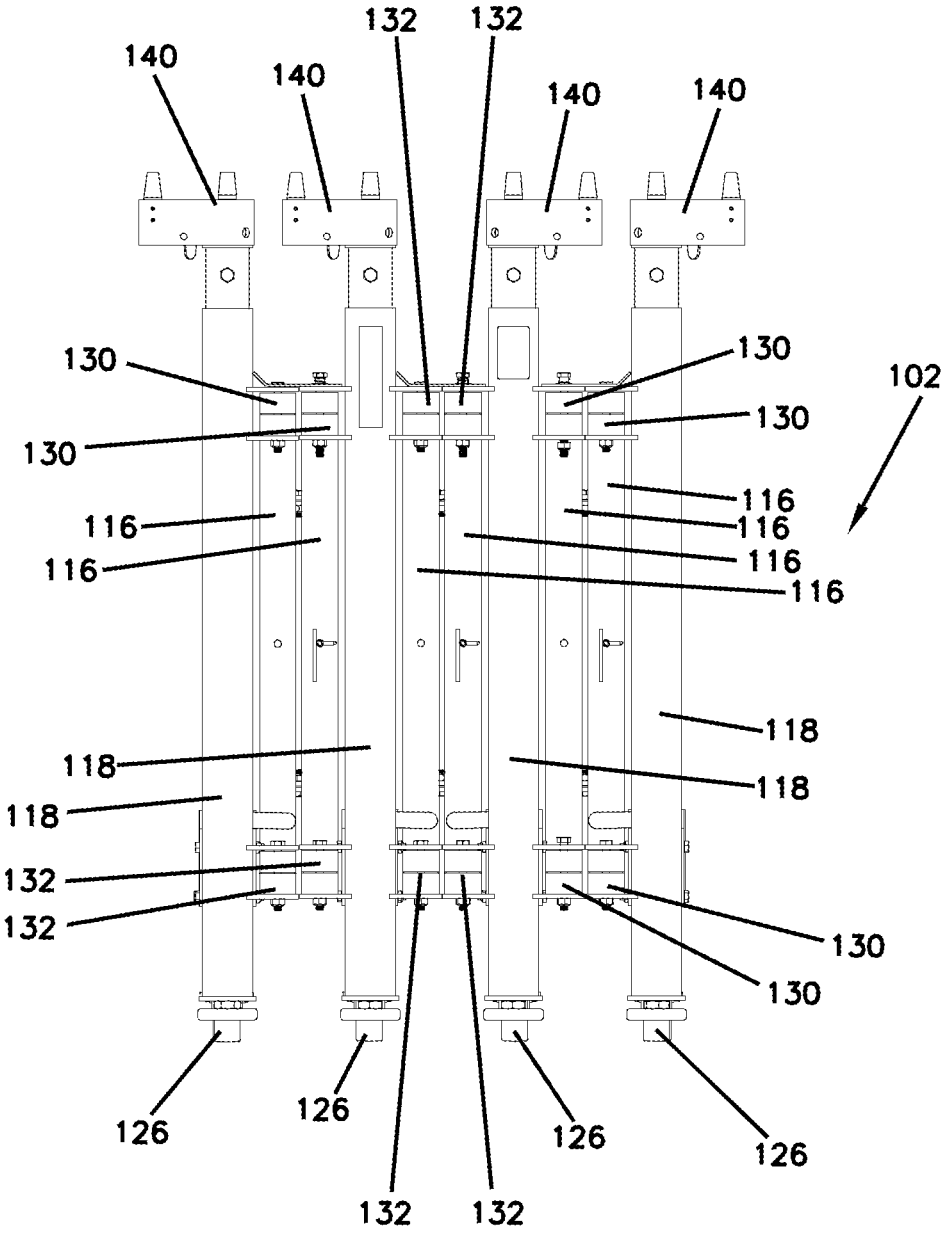
FIG. 8 is an end elevational view of the portable stage shown in FIG. 7.
Figure 9:
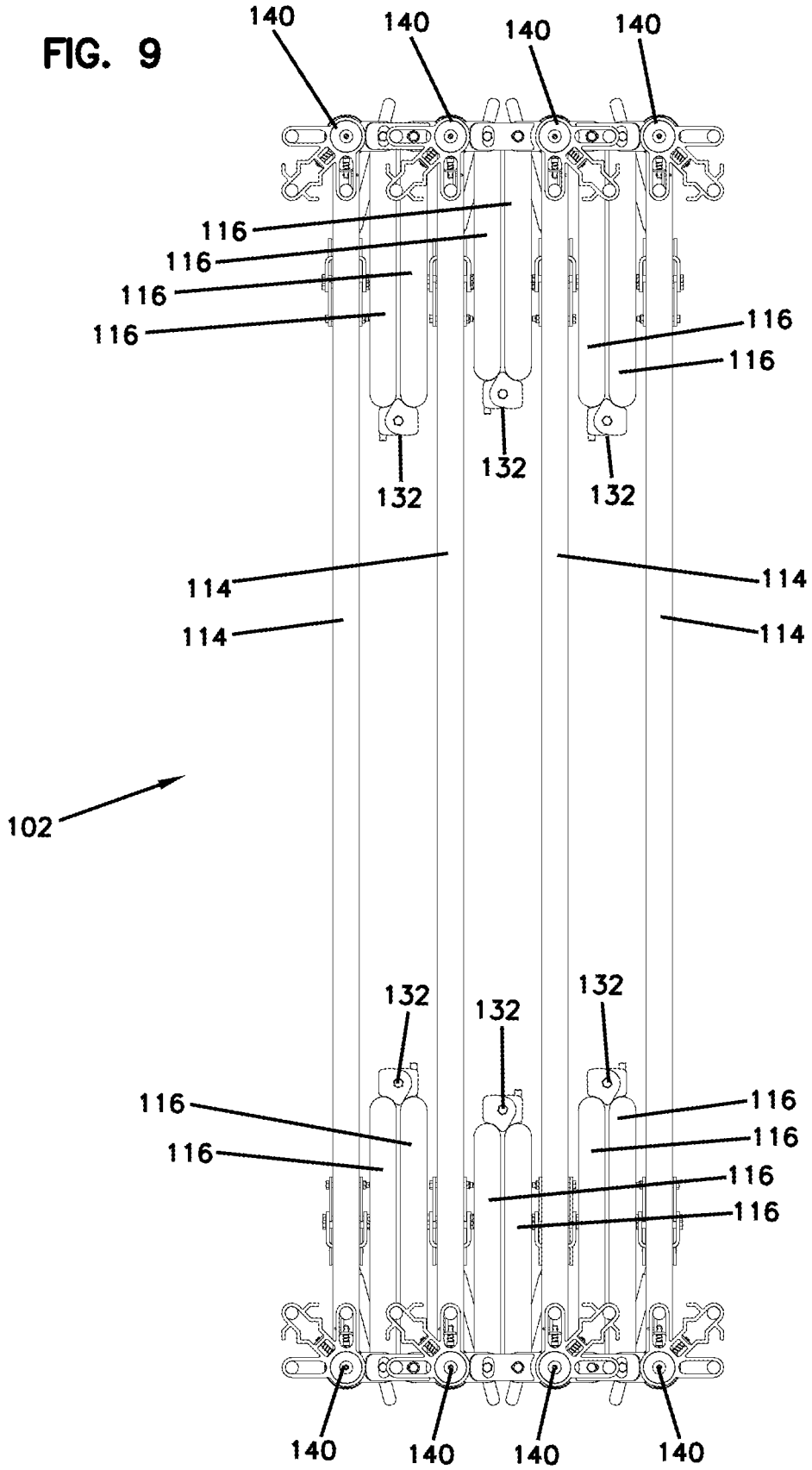
FIG. 9 is a top plan view of the portable stage shown in FIG. 7.
Figure 10:
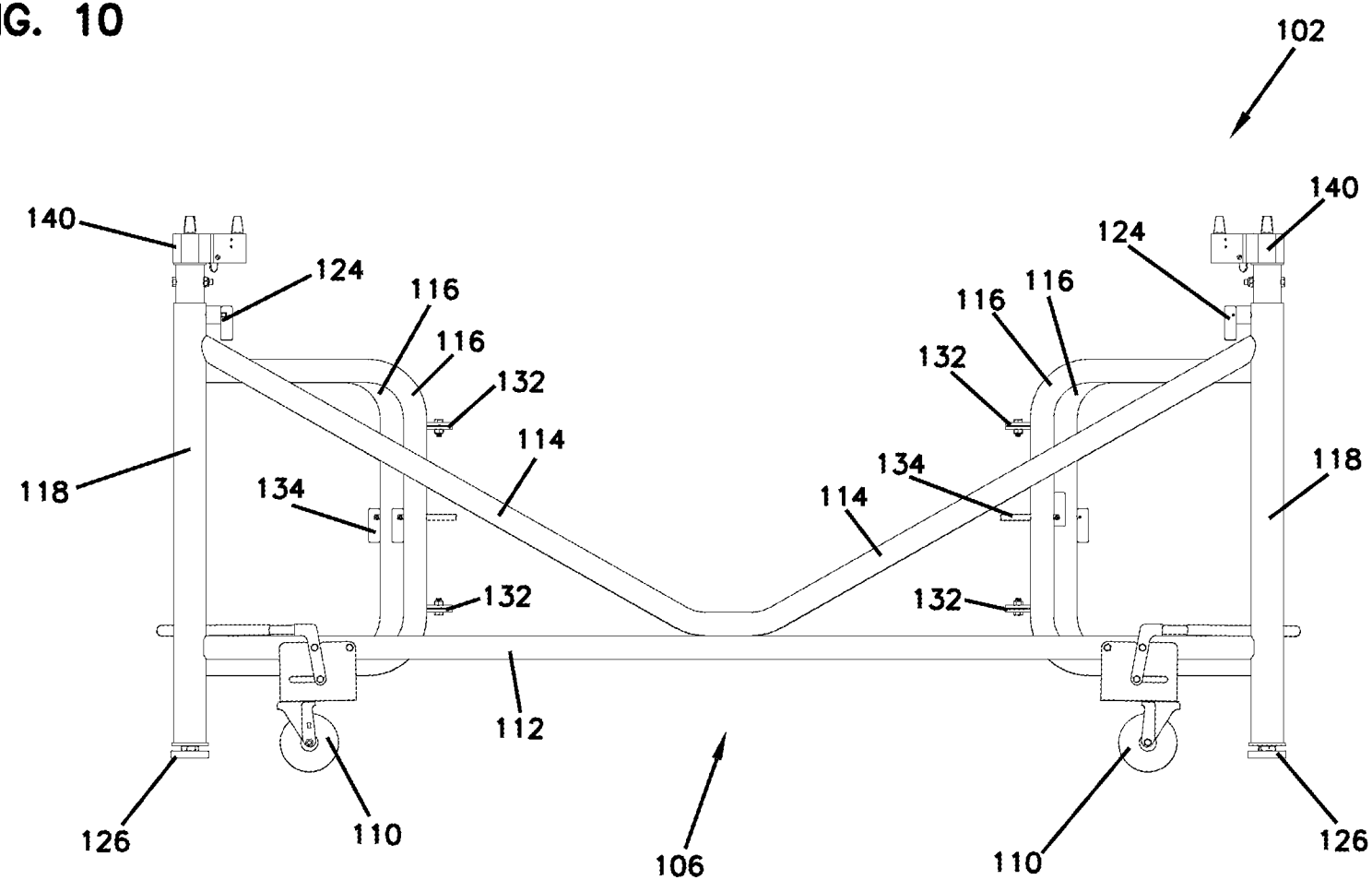
FIG. 10 is a side view of the portable stage shown in FIG. 7.
Figure 11:
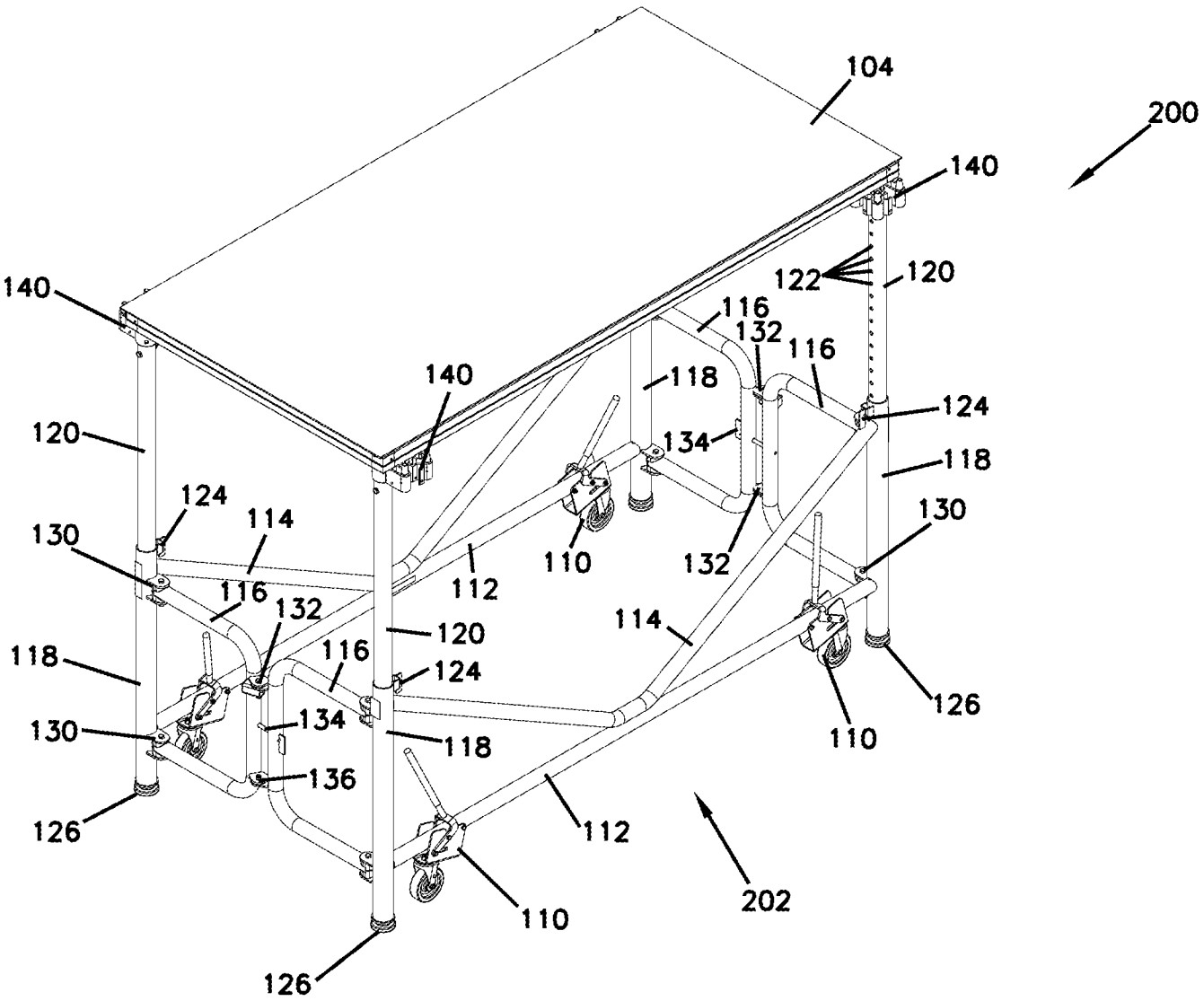
FIG. 11 is a perspective view of a second embodiment of a portable stage in an unfolded position according to the principles of the present invention.
Figure 12:
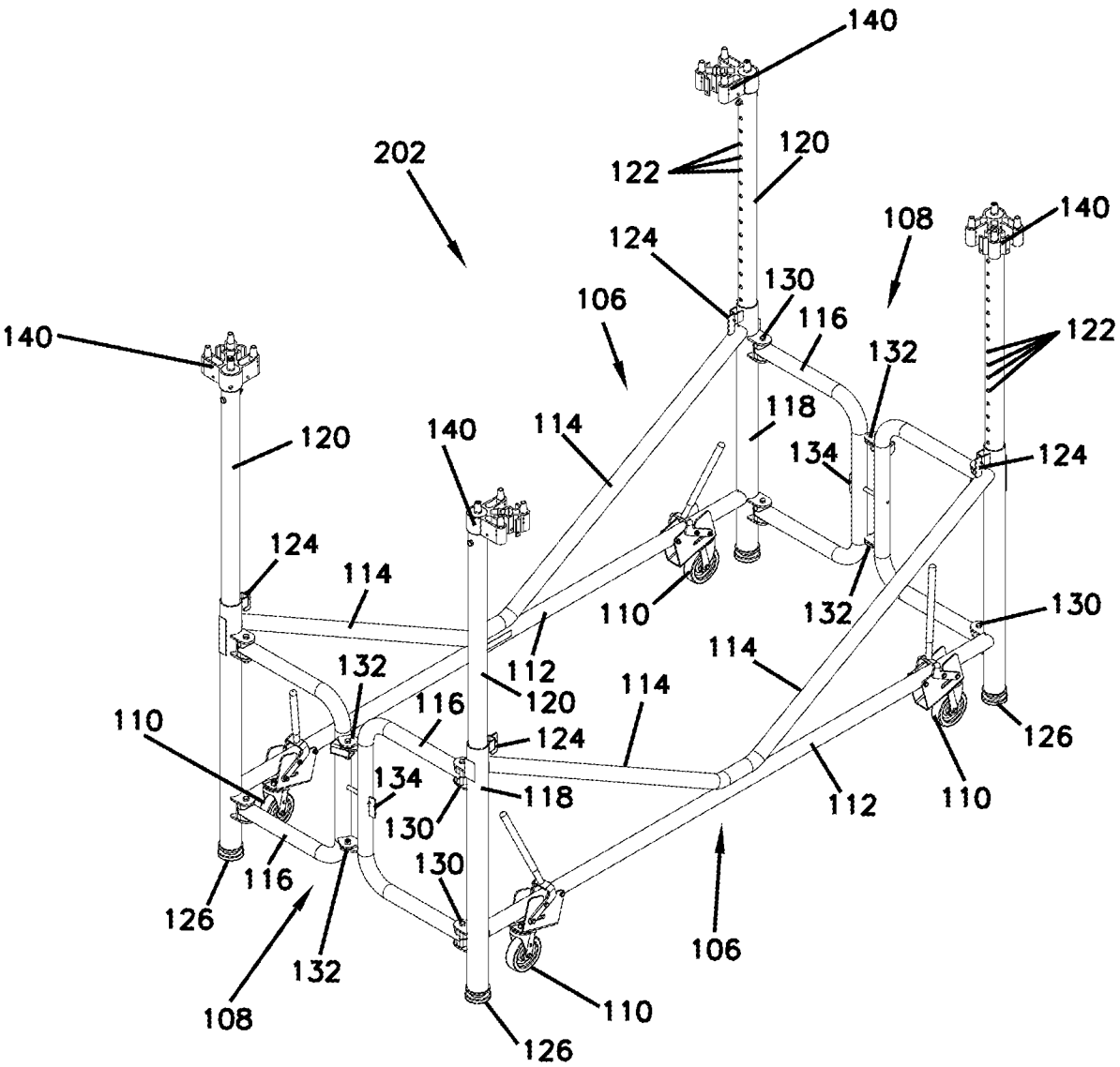
FIG. 12 is a perspective view of the portable stage shown in FIG. 11 with the decks removed.
Figure 13:
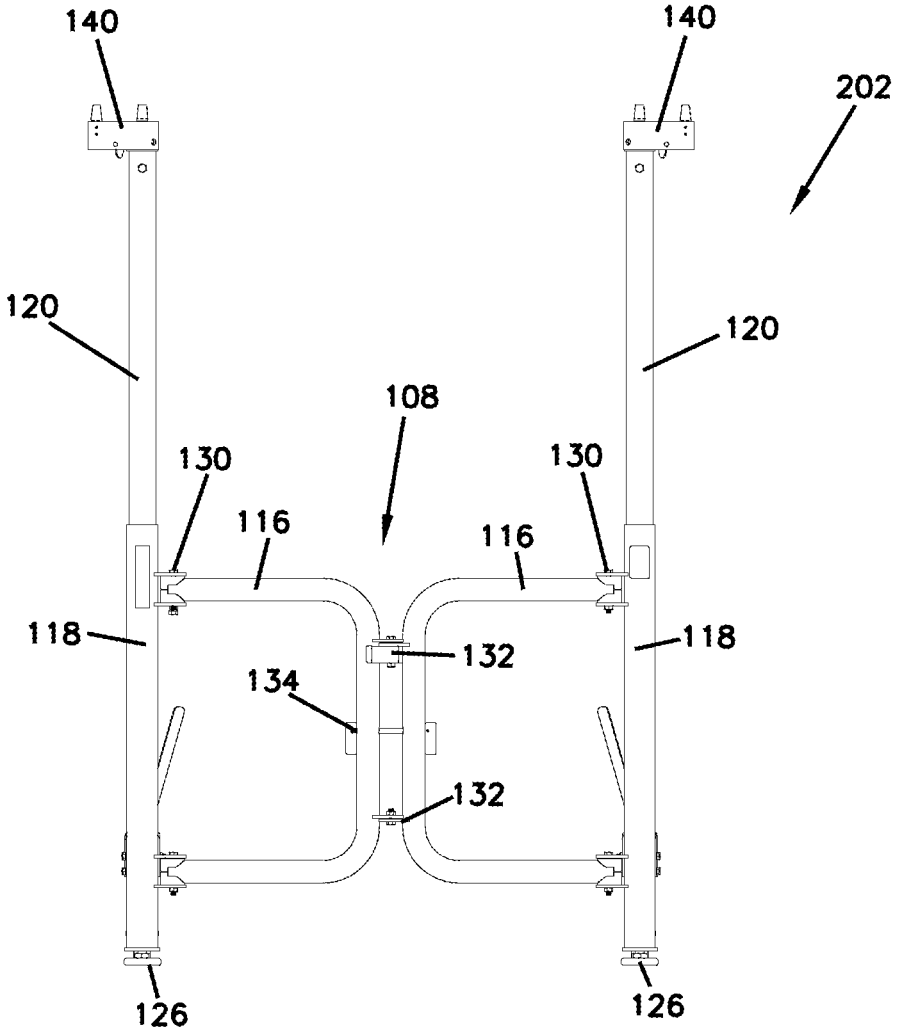
FIG. 13 is an end elevational view of the portable stage shown in FIG. 12.
Figure 14:
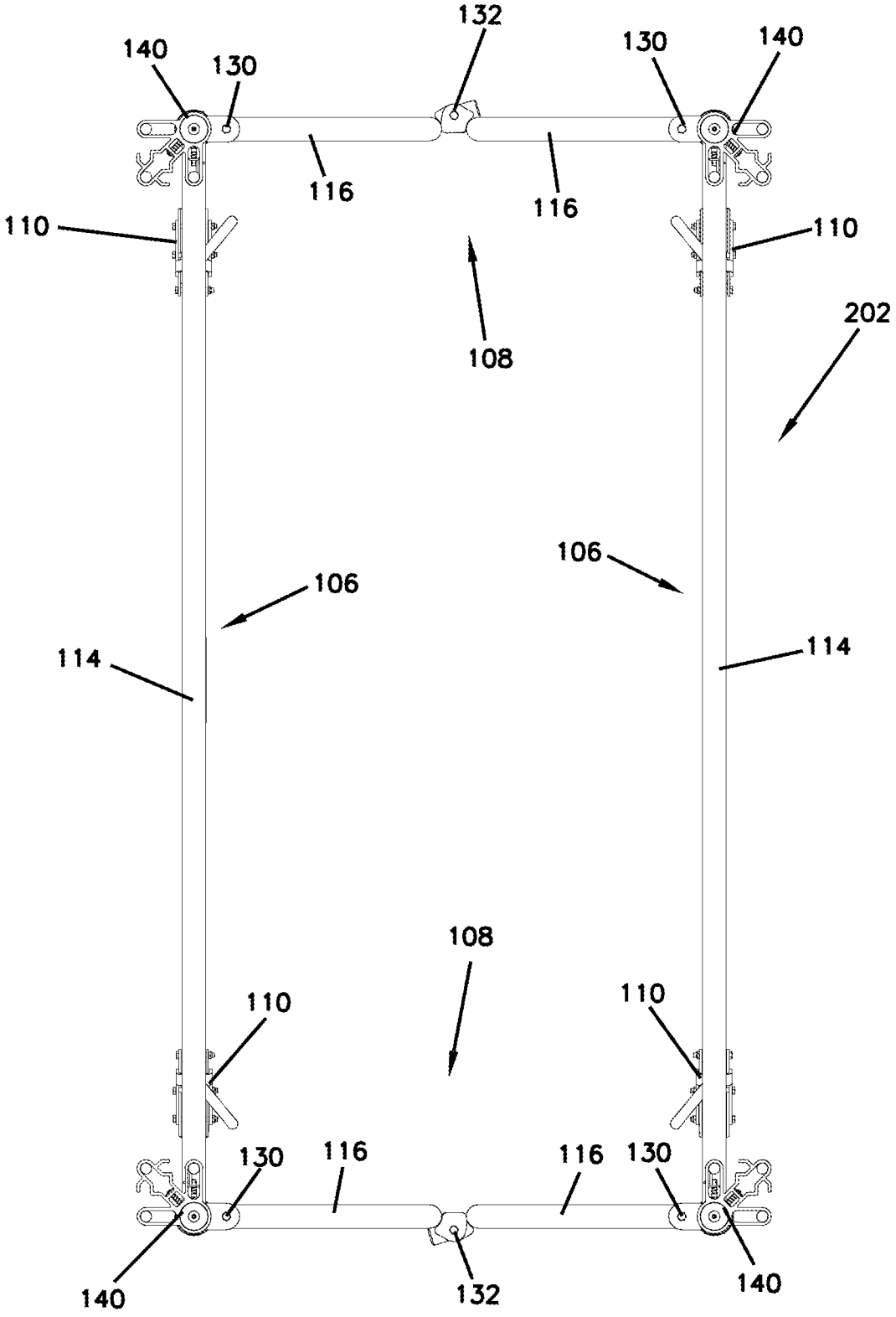
FIG. 14 is a top plan view of the portable stage shown in FIG. 12.
Figure 15:
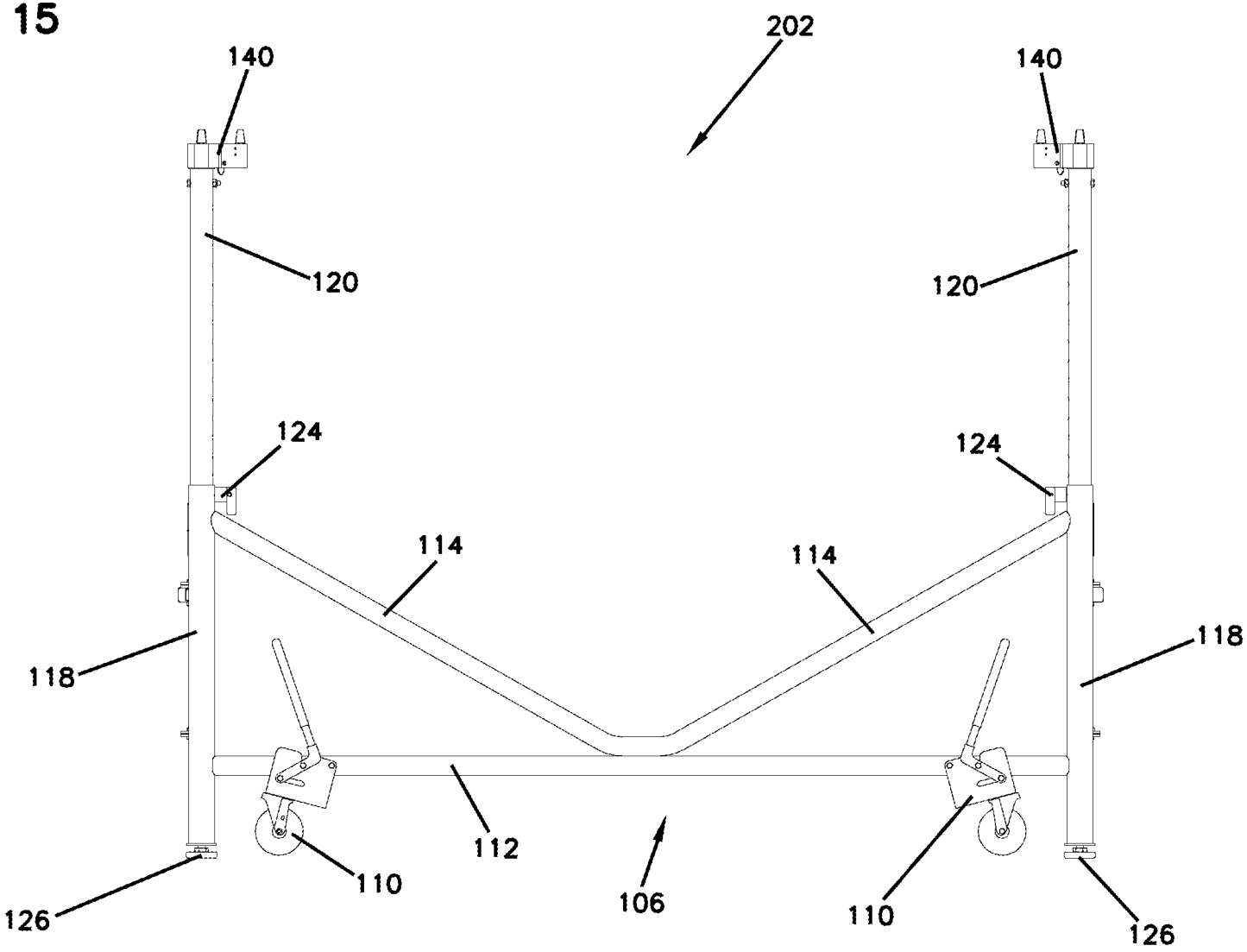
FIG. 15 is a side view of the portable stage shown in FIG. 12.
Figure 16:
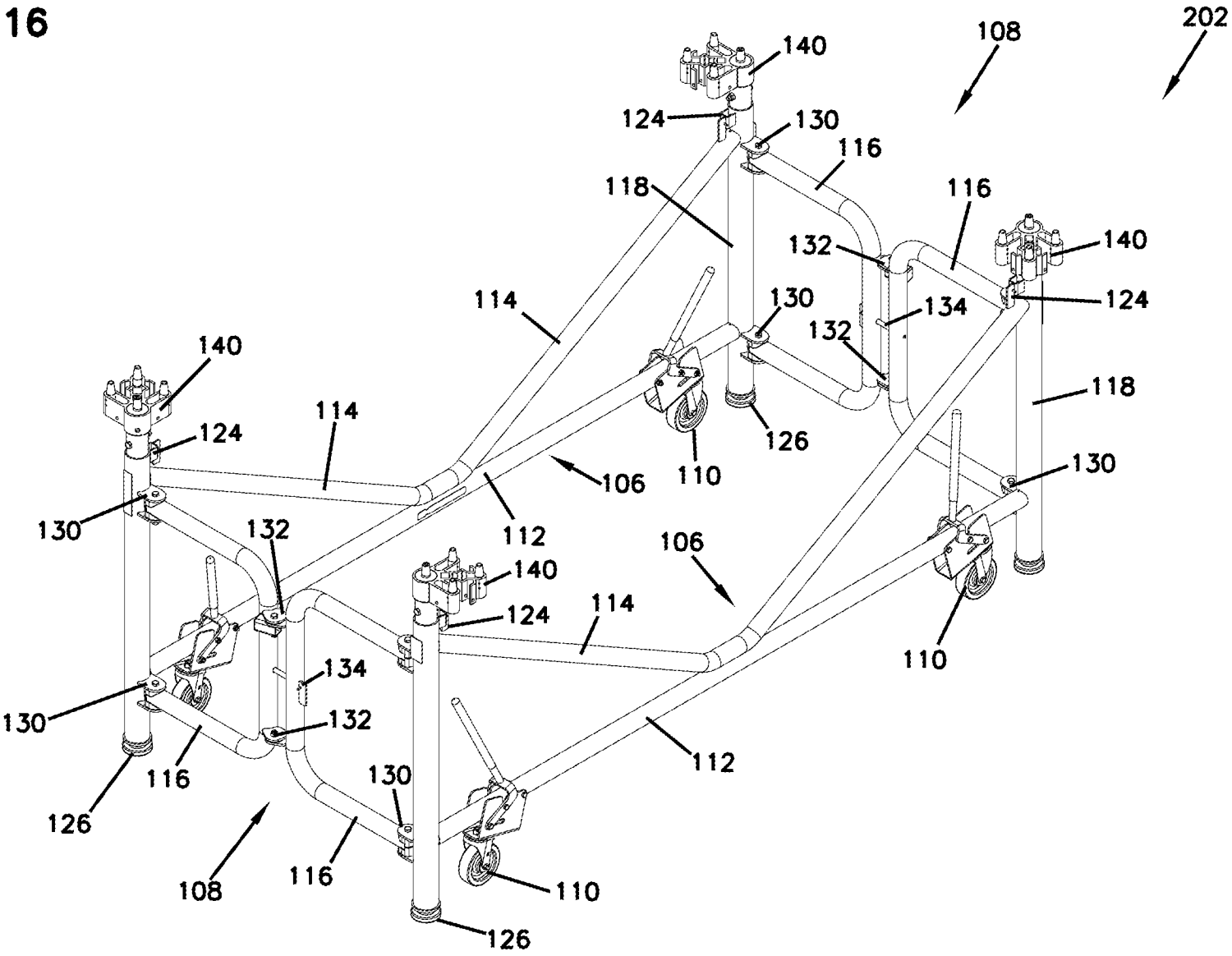
FIG. 16 is a perspective view of the portable stage shown in FIG. 12 with the deck support columns at a lowest position.
Figure 17:
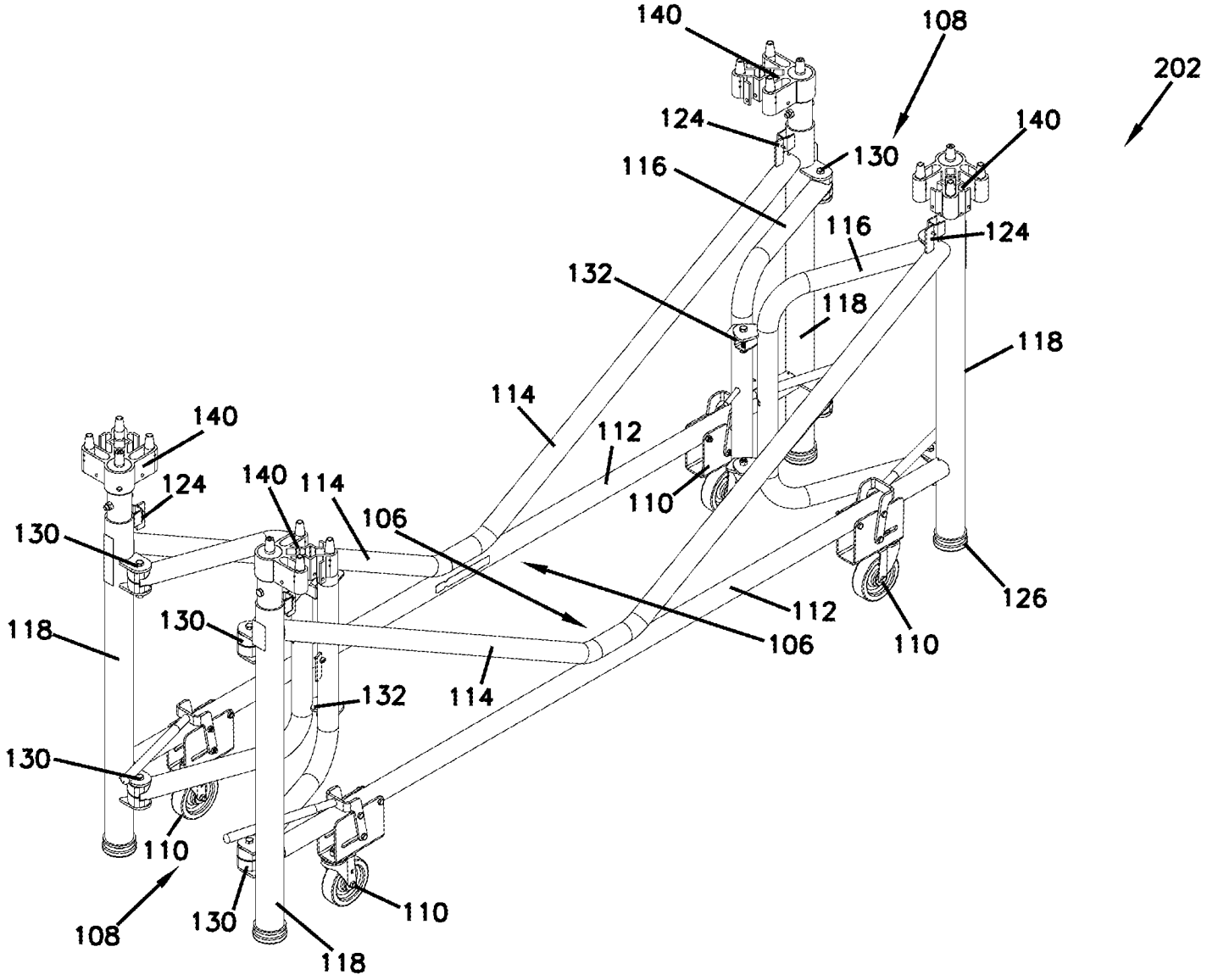
FIG. 17 is a perspective view of the portable stage age shown in FIG. 16 in a folded position.
Figure 18:
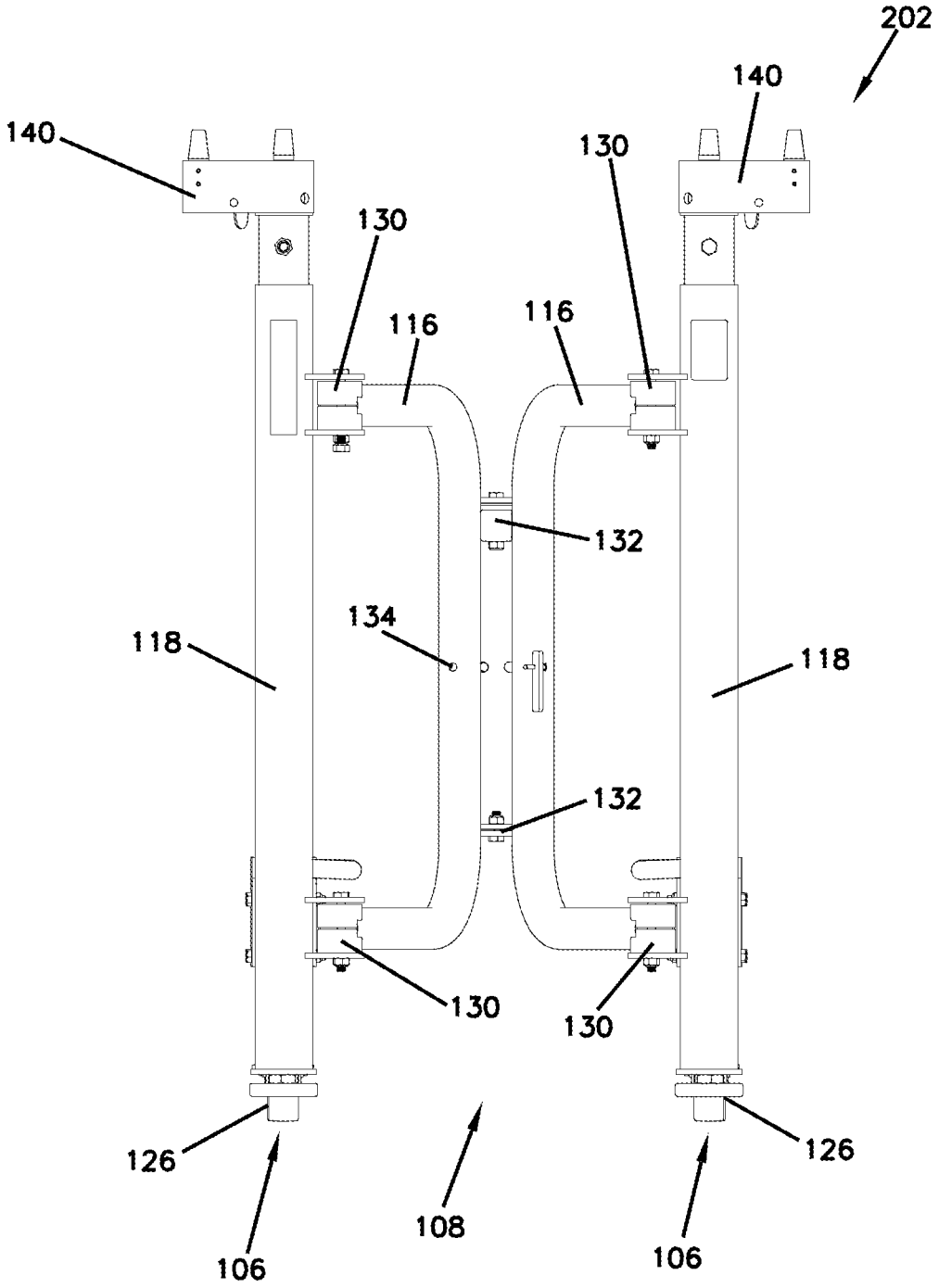
FIG. 18 is an end elevational view of the portable stage shown in FIG. 17.
Figure 19:
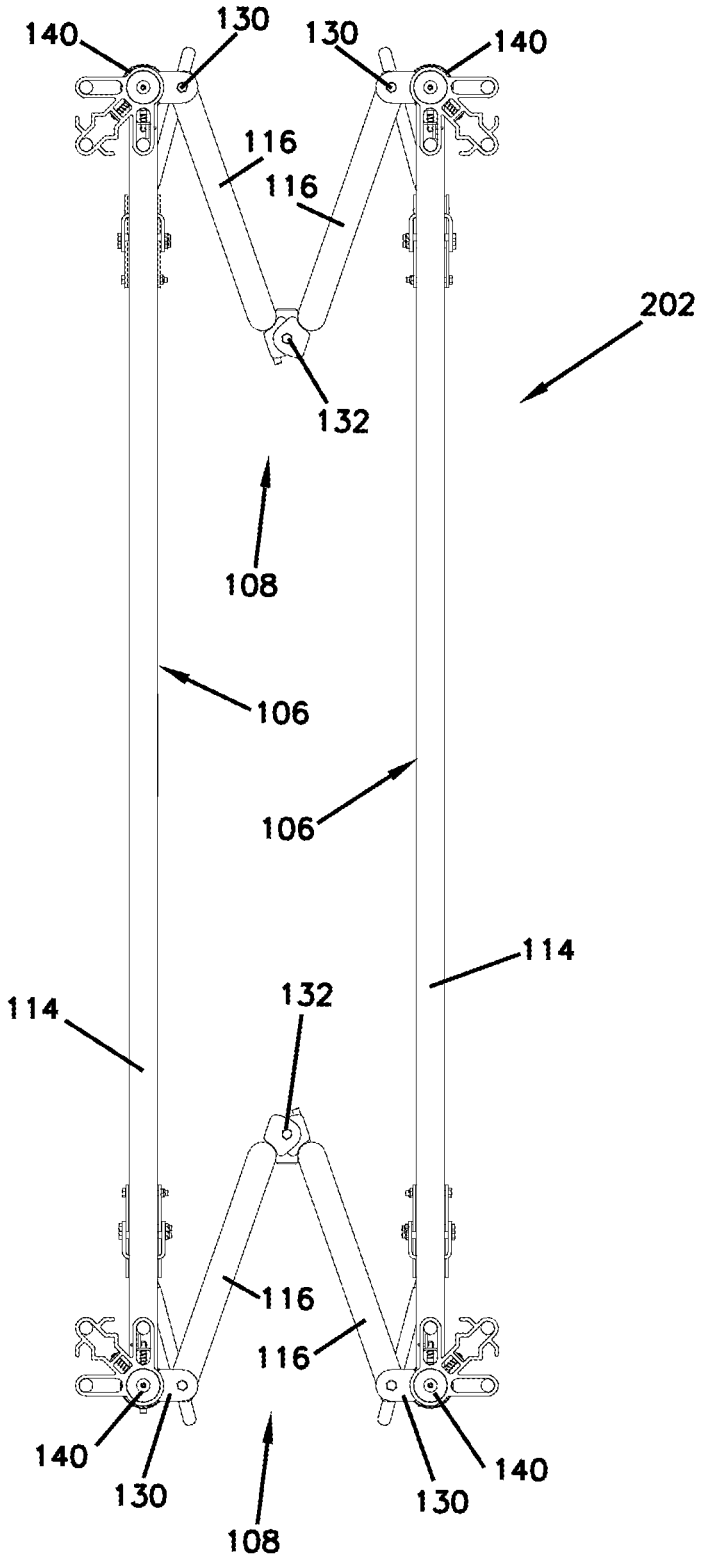
FIG. 19 is a top plan view of the portable stage shown in FIG. 17.
Figure 20:
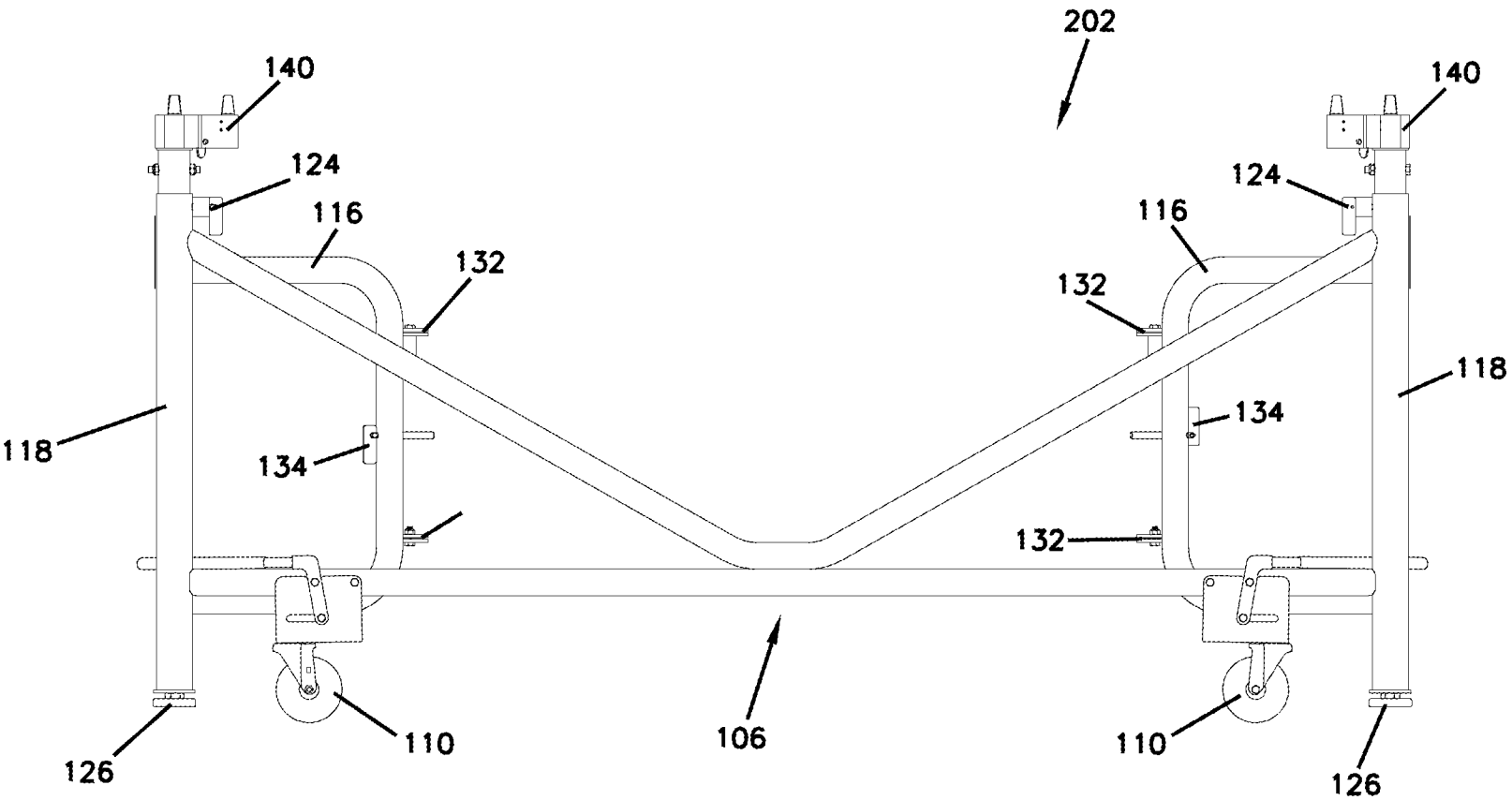
FIG. 20 is a side view of the portable stage shown in FIG. 17.

Referring now to the drawings and in particular to FIGS. 1-10, there is shown a portable stage, generally designated (100). In the embodiment shown in FIGS. 1-10, the stage (100) includes a folding framework (102) supporting three decks (104) in an extended side-by-side configuration. It can also be appreciated that bridging decks may be extended between and supported on the frameworks (102) to form an extended elevated stage surface. The folding framework (102) includes side frame assemblies (106) and folding end frame assemblies (108). The framework (102) includes selectively retractable caster assemblies (110). When the caster assemblies are lowered, the framework (102) is supported on the casters and may be rolled and easily moved. When the framework (102) is unfolded and ready for use, the casters are raised and the stages are supported on feet or glides (126).

The side frame assemblies (106) include lower horizontal frame members (112) and angled frame portions (114). The angled frame portions (114) form a generally V-shaped profile. The configuration provides for substantial open space below the decks (102) and above the angled frame portions (114). In the embodiment shown, the angled frame portions (114) are formed as a single element, but each angled frame portion (114) could be a separate element. The opening provides for access to the space below the stage decks (104) should items need to be stored or for workers to reach through the opening and arrange cabling and other elements. Moreover, the open configuration provides for satisfactory support and rigidity even when the stage decks are loaded. It can also be appreciated that the opening increases if the stage decks (104) are raised.

The stages decks (104) are supported on columns (118) generally at each corner of the deck. The columns (118) include telescoping elements (120) extending from the top of the framework (102). A pin (146) on a pin connector assembly (140) inserts into through holes, discussed hereinafter, and formed horizontally through the decks (104). The pin connector assembly (140) mounts on the top of a corresponding telescoping element (120). The height may be adjusted to multiple different heights by using a spring loaded adjustment pin (124) extending into spaced apart adjustment holes (122) in the telescoping elements (120). In the embodiment shown, the height may be varied between 48 inches and 78 inches. However, it can be appreciated that other heights and adjustment ranges may be accomplished by varying the height of the frame and/or telescoping elements.

The frameworks (102) fold for storage as shown in FIGS. 7-10. The end frame assemblies (108) include a pair of end frame members (116). The framework includes hinges (130) to pivotably mount the end frame members (116) to the side frame assemblies (106). In addition, hinges (132) at the center of the end frame assemblies (108) provide for hinged connection between the end frame members (116). A spring loaded pin (134) provides for selectively locking and releasing the end frame members (116). When the pin (134) is engaged to lock the end frame assembly (108) in the unfolded use position, the framework (102) is positioned so that pins (146) are properly aligned with the through holes formed through the decks (104). As shown in FIGS. 7-10, with the decks removed, the folding frameworks (102) can be folded to a more compact configuration, taking up less space and having a smaller footprint than in the unfolded use position. Therefore, the present invention requires less storage space than a permanent deck or an unfolding stage or a stage that lacks removable decks. When in the folded configuration, the frameworks (102) may be easily transported by rolling on the casters of the lowered caster assemblies (110).

In a second embodiment, shown in FIGS. 11-20, the portable stage is configured as a single deck unit, generally designated (200). The single portable stage (200) is generally configured with elements similar to the stage (100) supporting three decks. However, the framework (202) includes only four frame columns (118) and only one set of end frame assemblies (108). It can be appreciated that the framework elements are standardized and generally interchangeable to decrease manufacturing costs. Moreover, the rectangular decks (104) may be used for all units. The single stage (200) is also capable of supporting bridging decks between frameworks (202) and may be combined with other stages of other sizes in various configurations to achieve a wide range of elevated extended stage sizes and configurations.

Figure 21:
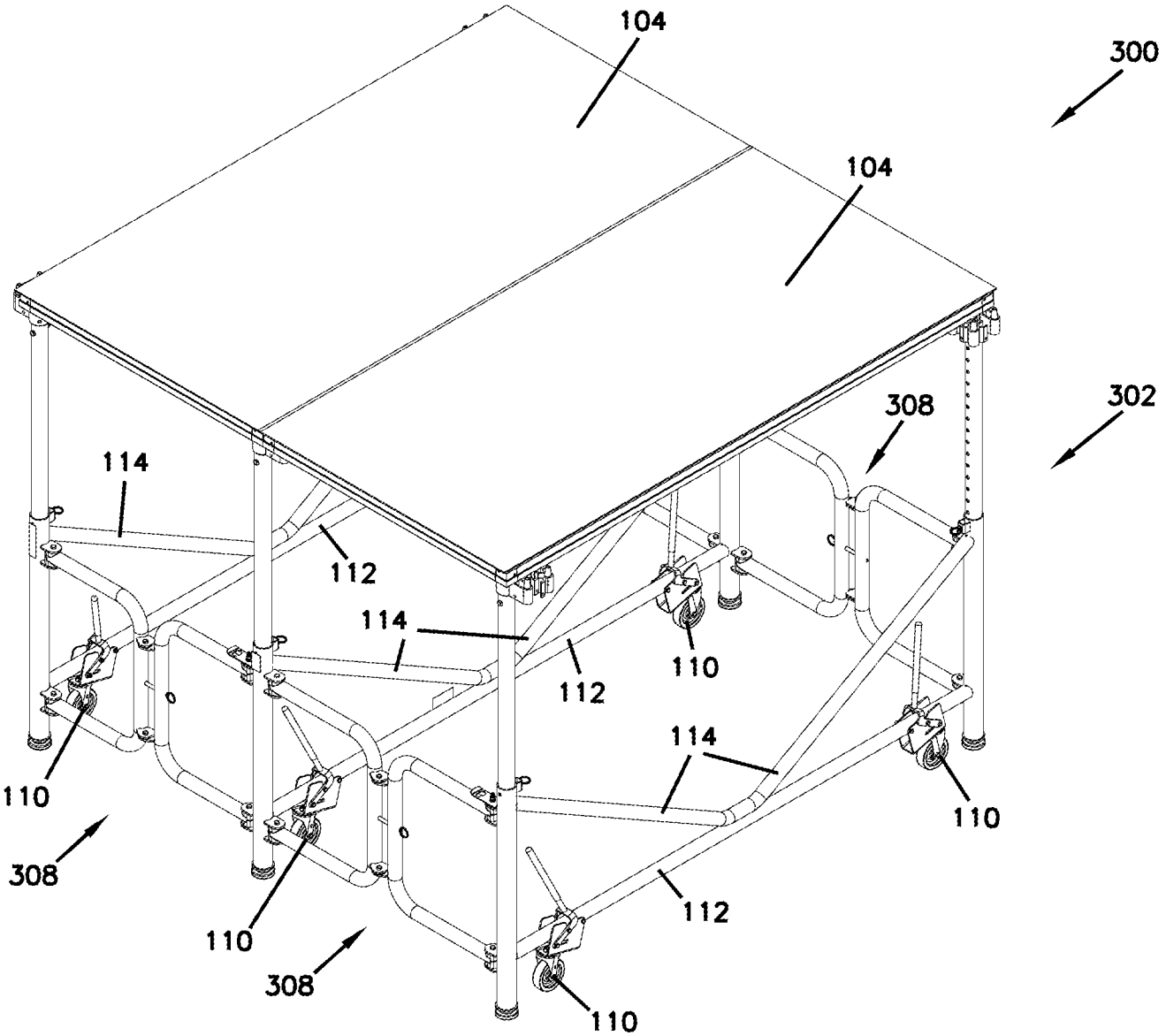
FIG. 21 is a perspective view of a third embodiment of a portable stage in an unfolded position according to the principles of the present invention.
Figure 22:
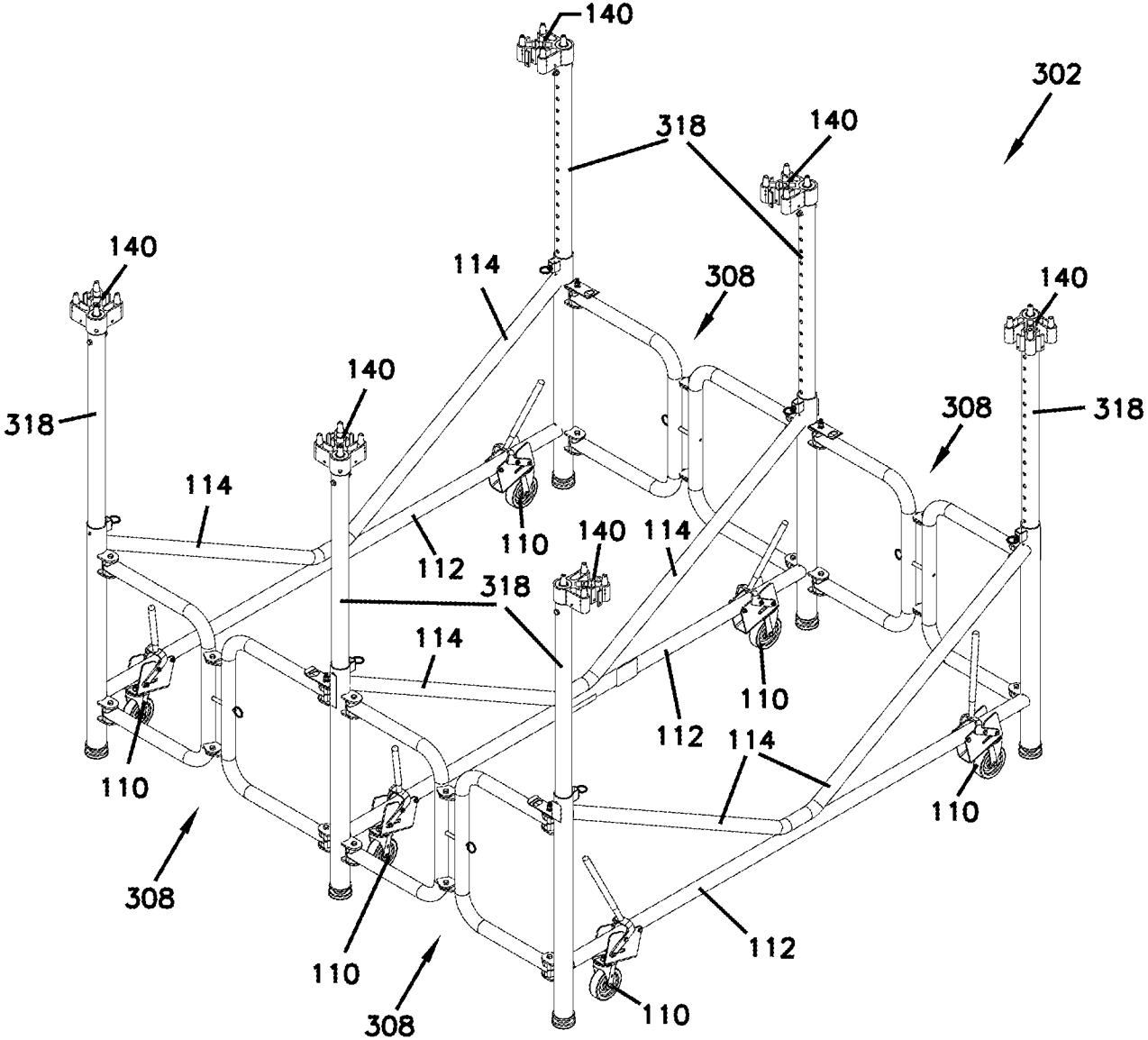
FIG. 22 is a perspective view of the portable stage shown in FIG. 21 with the decks removed.
Figure 23:
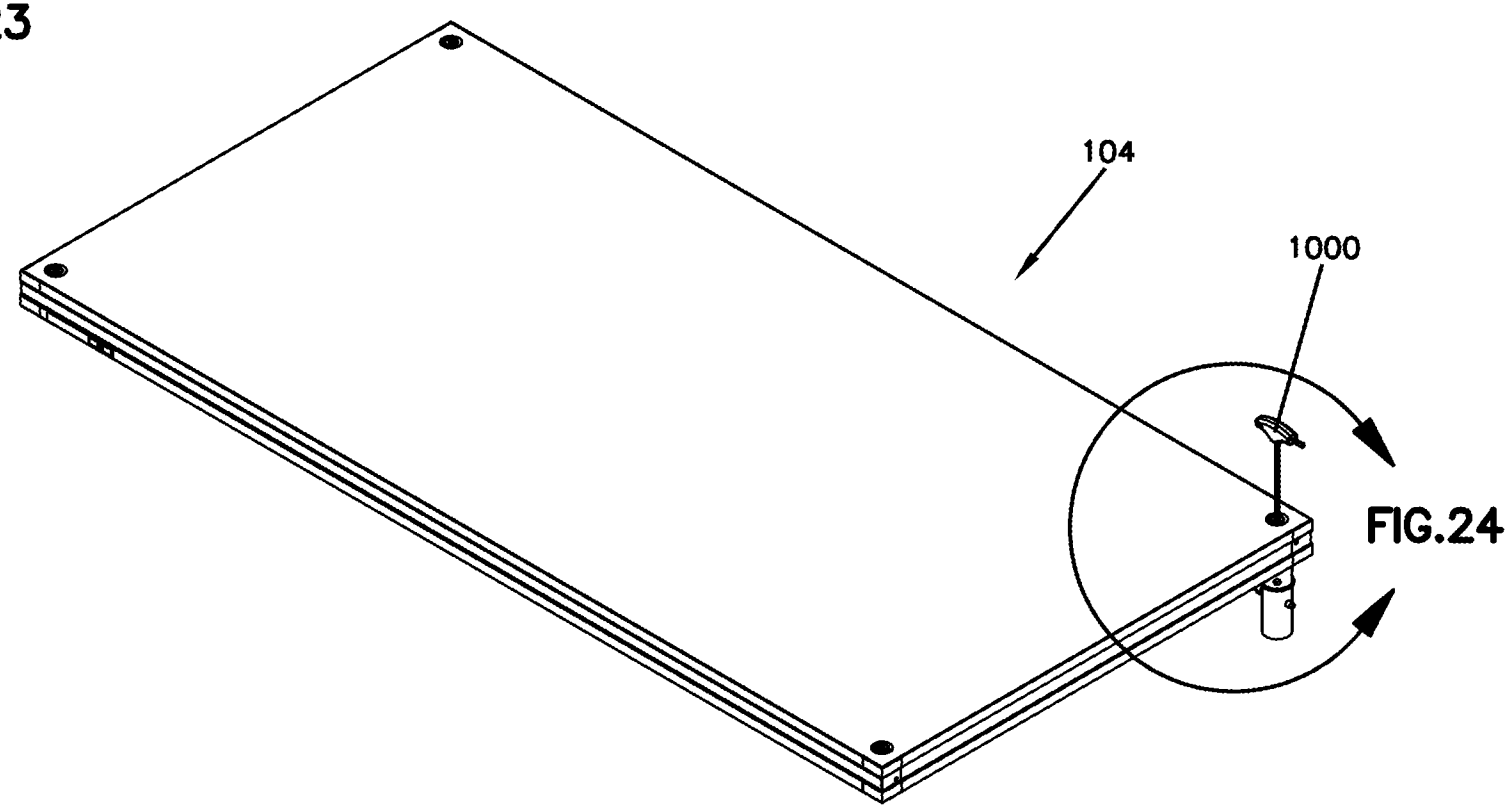
FIG. 23 is a perspective view of a stage deck and a support for the stage shown in FIG. 1, FIG. 11 or FIG. 21 with an adjustment tool inserted.
Figure 24:
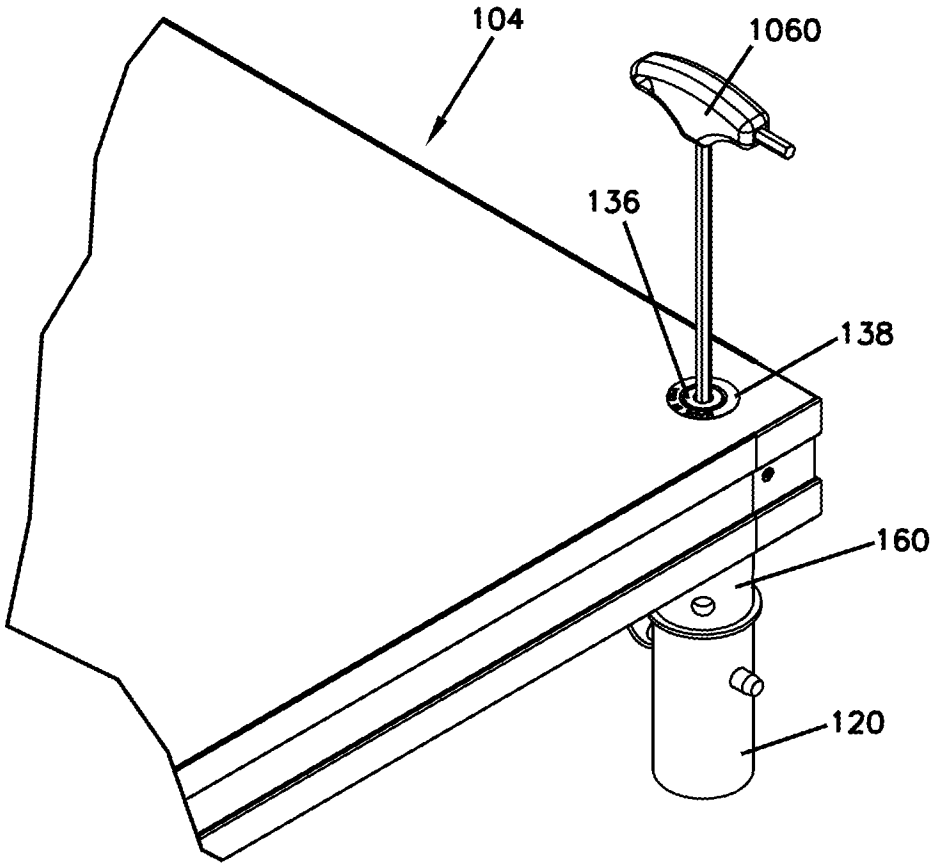
FIG. 24 is a detail view of the deck, support and tool shown in FIG. 23.

In a third embodiment, shown in FIGS. 21-22, the portable stage is configured as a double deck unit, generally designated (300). The double portable stage (300) is generally configured with elements similar to the stage (100) supporting three decks or the stage (200) supporting a single deck. However, the framework (302) includes six frame columns (318) and only two sets of end frame assemblies (308). Moreover, the rectangular decks (104) may be used for all units. The double stage (300) is also capable of supporting bridging decks between frameworks (302) and may be combined with the triple deck stages (100) and/or the single deck stages (300) in various configurations to achieve a wide range of elevated stage sizes and configurations. The use of different size frameworks provides great flexibility in layout and design for a wide range of needs and applications. It can also be appreciated that the stages may be used with stages of different heights in a riser configuration or to create a multiple level stage.

Referring now to FIGS. 23-26, the decks (104) shown are lightweight, generally rectangular elements. A typical deck is four feet wide by eight feet long. However, other shapes are possible including square decks, triangular decks or other trapezoidal decks. The decks (104) include a vertical through hole (136) near each corner of a deck (104) that receives a pin connector as explained hereinafter. A sleeve type insert (138A) is slidably positioned in the through hole (136) to fill the through hole and to help align the pin. The sleeve type insert (138A) is retained by endcaps (138B) flush with each face of the deck (104). The endcaps (138B) each include a center opening that provides for insertion of the pin (146). When the deck is mounted on the framework (102 or 202), the pin (146) extends through the opening in the bottom endcap (138B) and pushes the sleeve (138A) upward proximate an inner face of the top endcap (138B). In this manner, the through hole (136) is substantially filled and an endcap (138B) is supported and substantially flush with the deck face regardless of which face of the deck (104) is the top surface. Moreover, the sleeve (138A) is retained within the through hole (136) by the endcaps (138B) so the sleeve element (138A) cannot be lost.

Referring now to FIGS. 27-32, there is shown an adjustable pin connector assembly, generally designated (140). The pin connector assembly (140) includes a housing (142) including a cylindrical corner portion (142D) and arm portions (142A, 142B, 142C) that receive rotatable connector pins (144). The cylindrical corner portion (142D) of the housing (142) attaches to a height adjustment assembly (160) at the upper end of the telescoping elements (120) of the frame columns (118). The pin connector assemblies (140) may be used with either the triple stage (100), the double stage (300) or the single stage (200). The rotatable pins (144) mount on horizontal shafts and extend between a lowered position in which the pins (144) extend substantially horizontally and a raised position in which the pins (144) extend vertically and may extend into through holes (136) of a bridging deck (104). The pin connector assembly (140) may also be positioned on the telescoping element (120) so that the housing (142) is pointing inwardly underneath the deck (104) and such as may be required at a corner position. Moreover, for edges of a stage, the pin connector assembly (140) may be positioned so that only one, two or all three of the rotatable pins (144) are beyond an edge of the stage (100), (200) or (300).

A release assembly (148) includes a handle (150) in the center arm portion (142B), a pin (152) and a spring (154). The pin (152) selectively extends through a corresponding orifice in the housing and height adjustment assembly (160) and allows for removal of the pin connector assembly (140) as well as rotation so that the pin connector assembly (140) may be oriented in the correct position. The handle (150) extends below the housing (142) and is simply pivoted outward to release the housing (140) from the height adjustment assembly (160). The housing (142) also includes a guardrail mounting surface (156) and a backup mounting surface (158) on the center arm portion (142B). The surfaces (156) and (158) allow for mounting a guardrail to the pin connector assembly rather than to the decks as was done with prior art stages. The mounting surfaces are positioned off the center arm and oriented so that the guardrail is positioned parallel to the edge of the decks.

Figure 31:
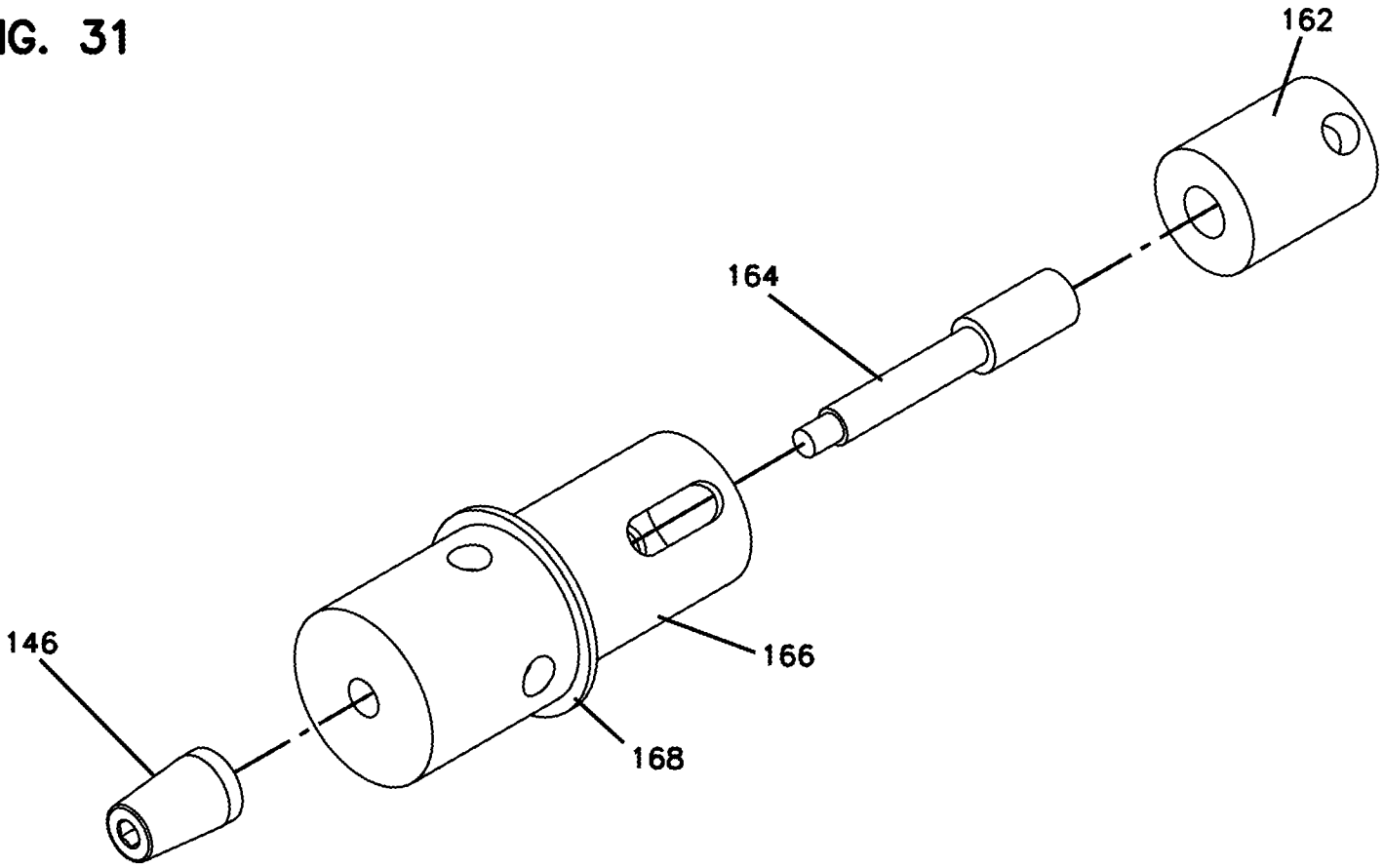
FIG. 31 is an exploded perspective view of an adjustable pin connector for the pin connector assembly shown in FIG. 27.
Figure 32:
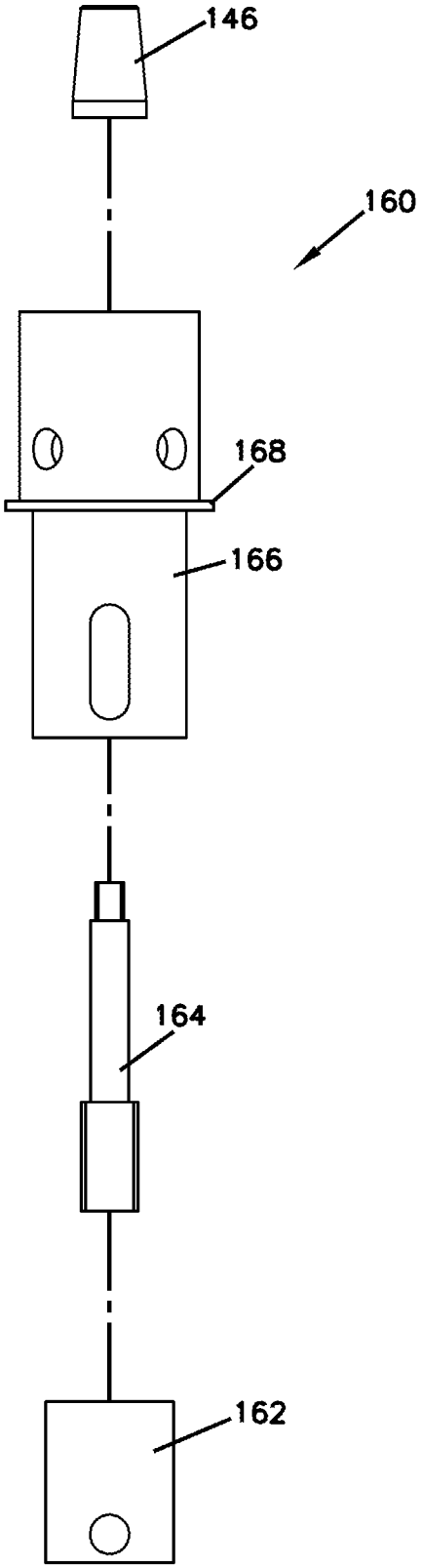
FIG. 32 is an exploded side view of the adjustable pin connector shown in FIG. 31.
Figure 33:
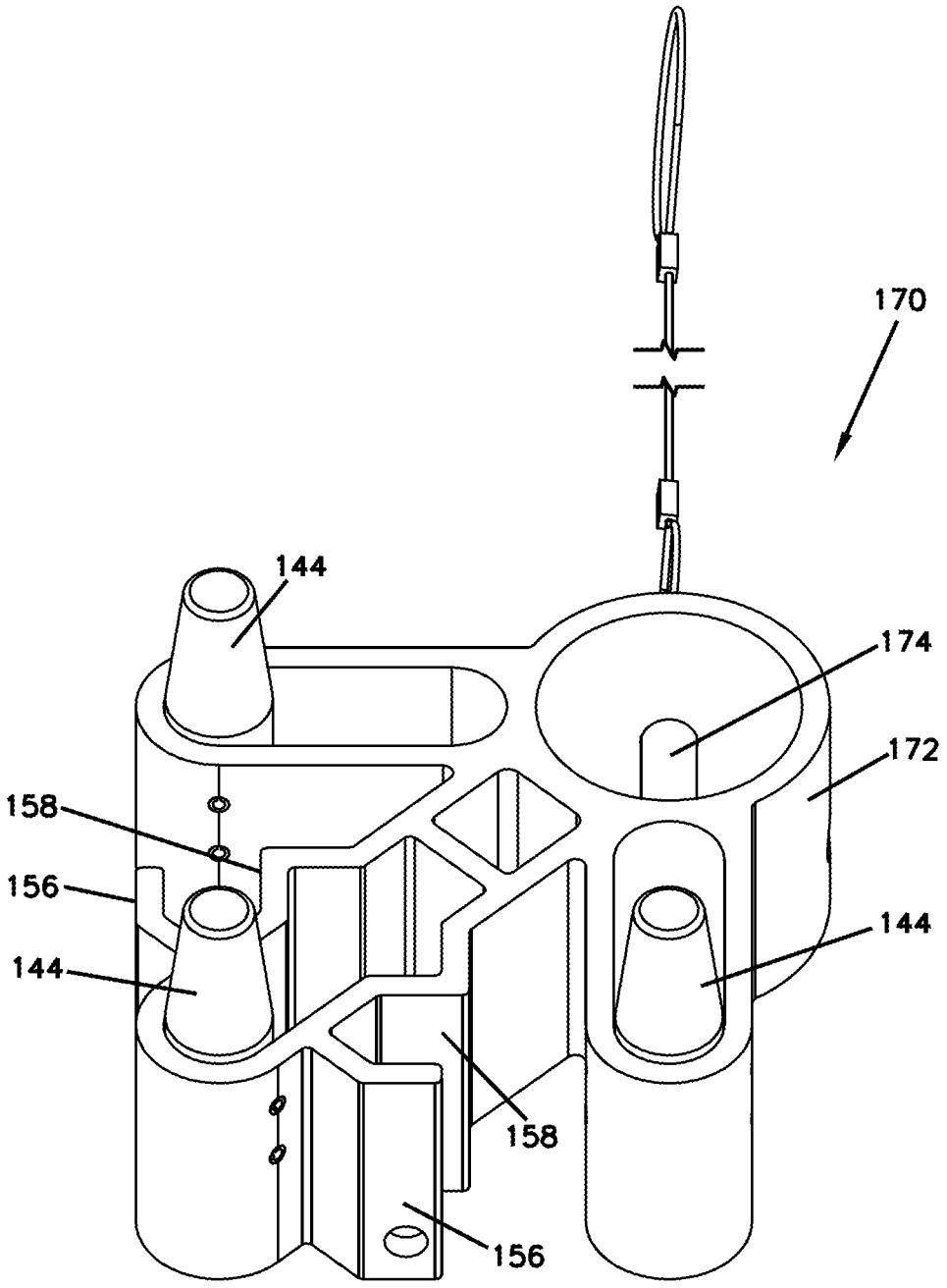
FIG. 33 is a perspective view of a fixed pin connector assembly for the stage shown in FIG. 1, FIG. 11 or FIG. 21.
Figure 34:
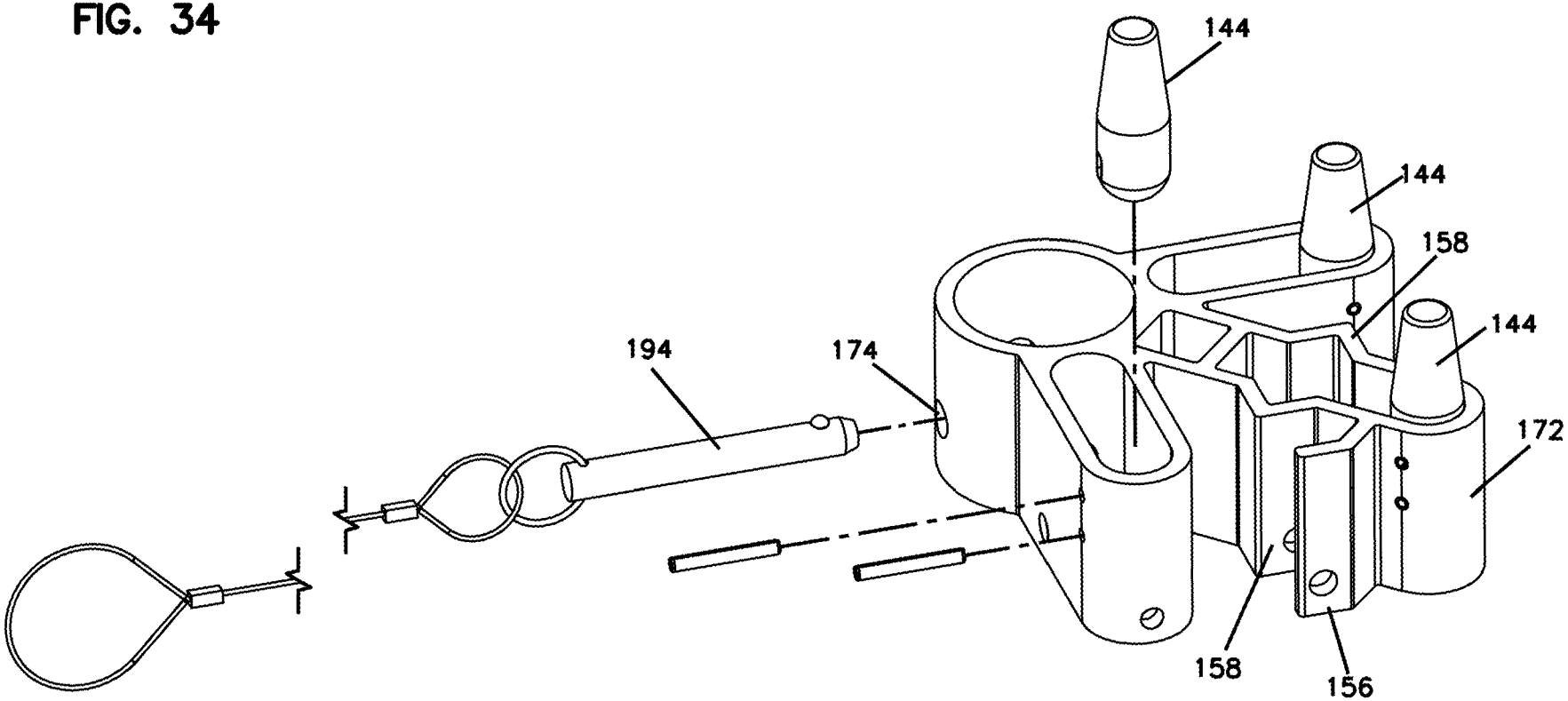
FIG. 34 is a partially exploded perspective view of the pin connector assembly shown in FIG. 33.
Figure 35:
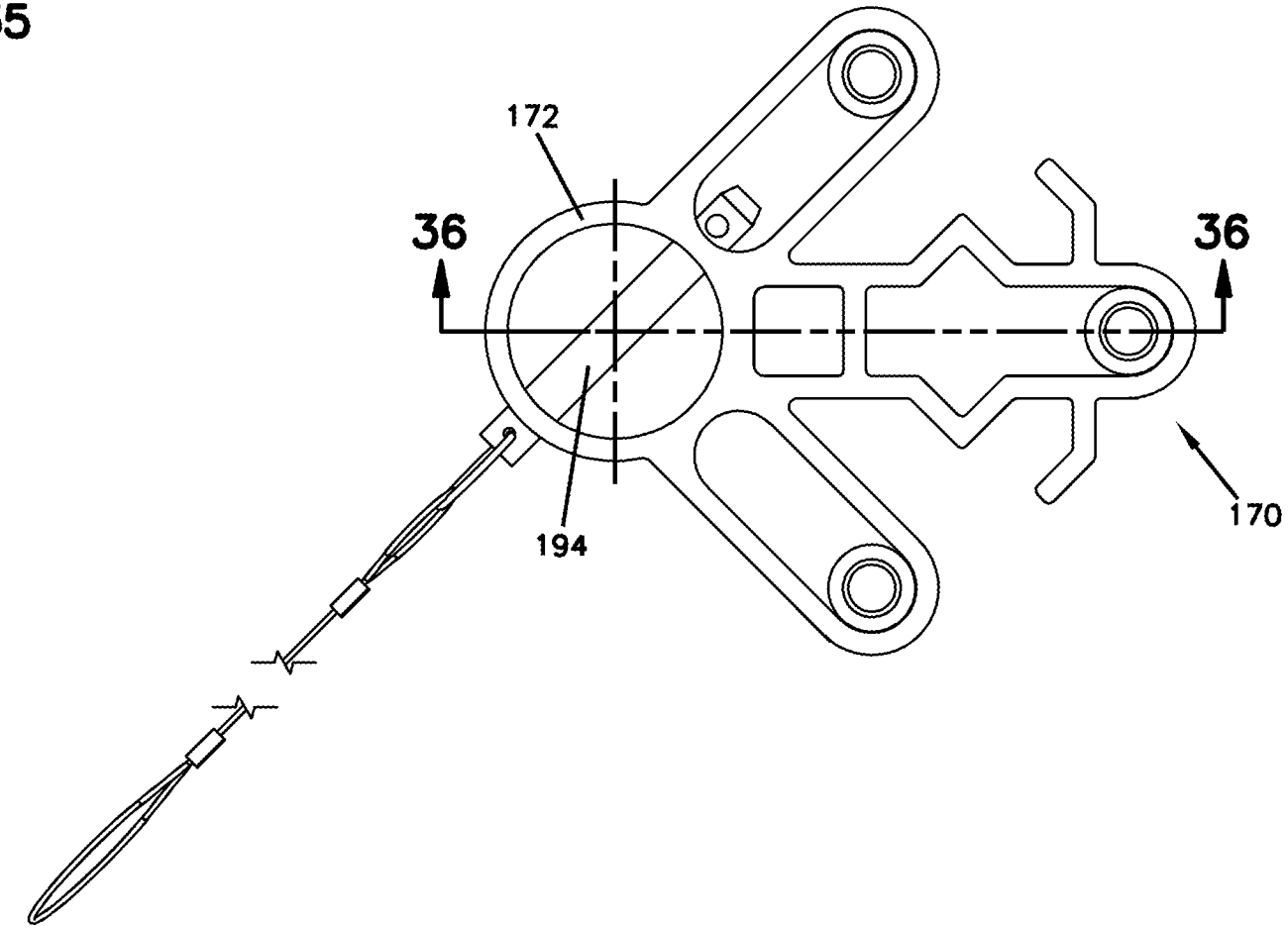
FIG. 35 is a top plan view of the pin connector assembly shown in FIG. 33.
Figure 36:
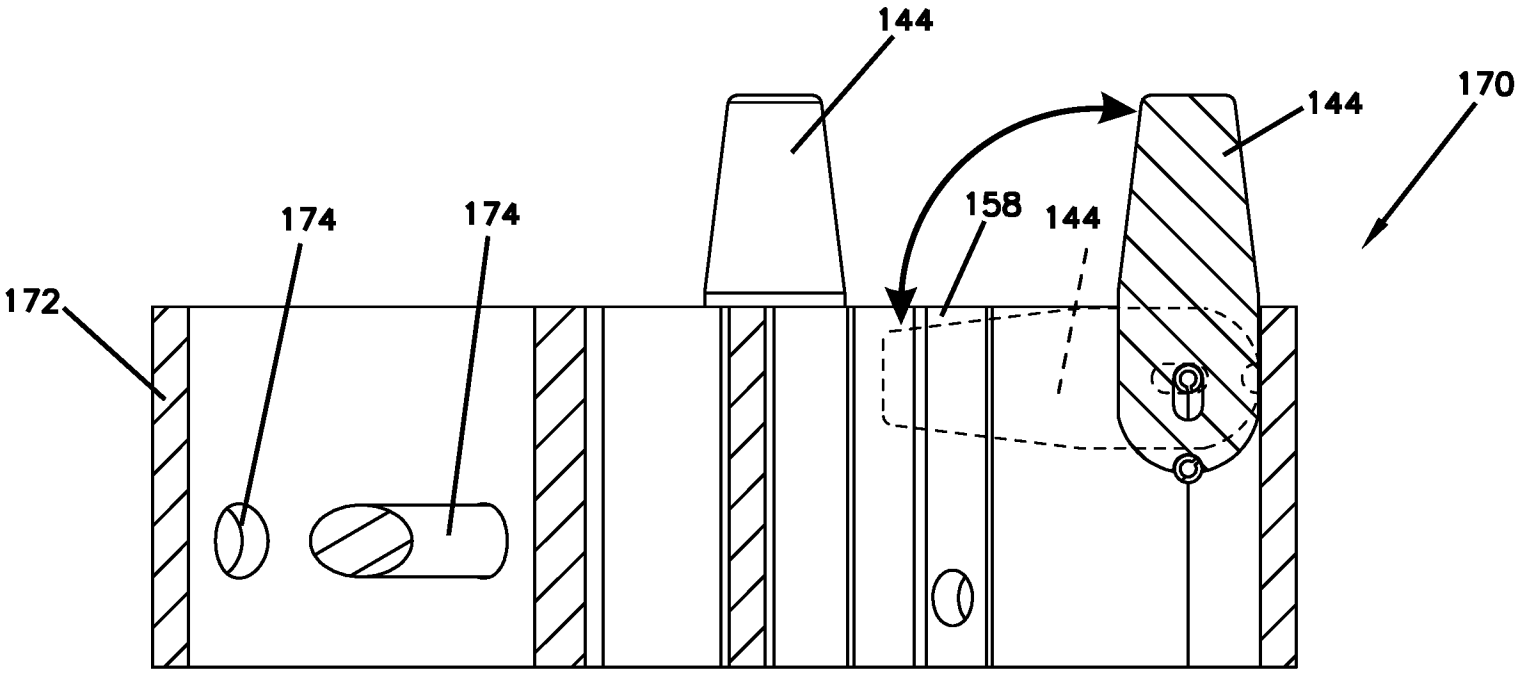
FIG. 36 is a sectional view taken along line 36-36 of FIG. 35.
Figure 37:
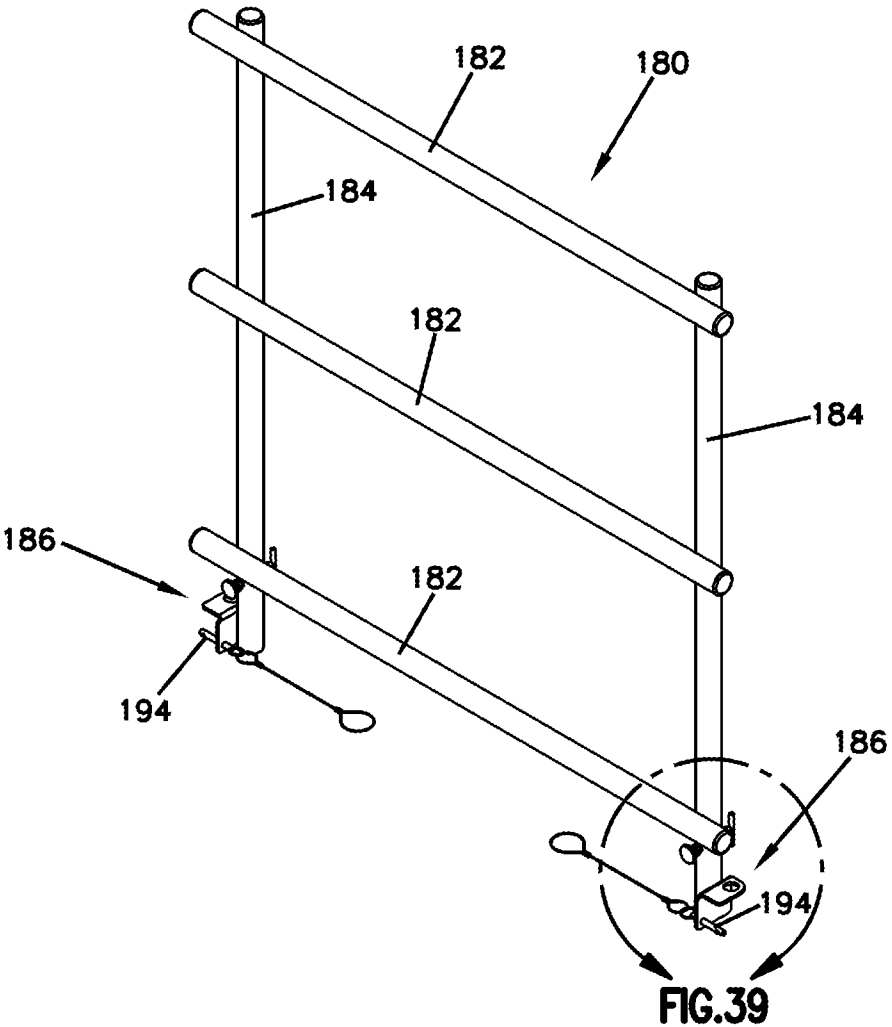
FIG. 37 is a perspective view of a removable guardrail for the stage shown in FIG. 1, FIG. 11 or FIG. 21.
Figure 38:
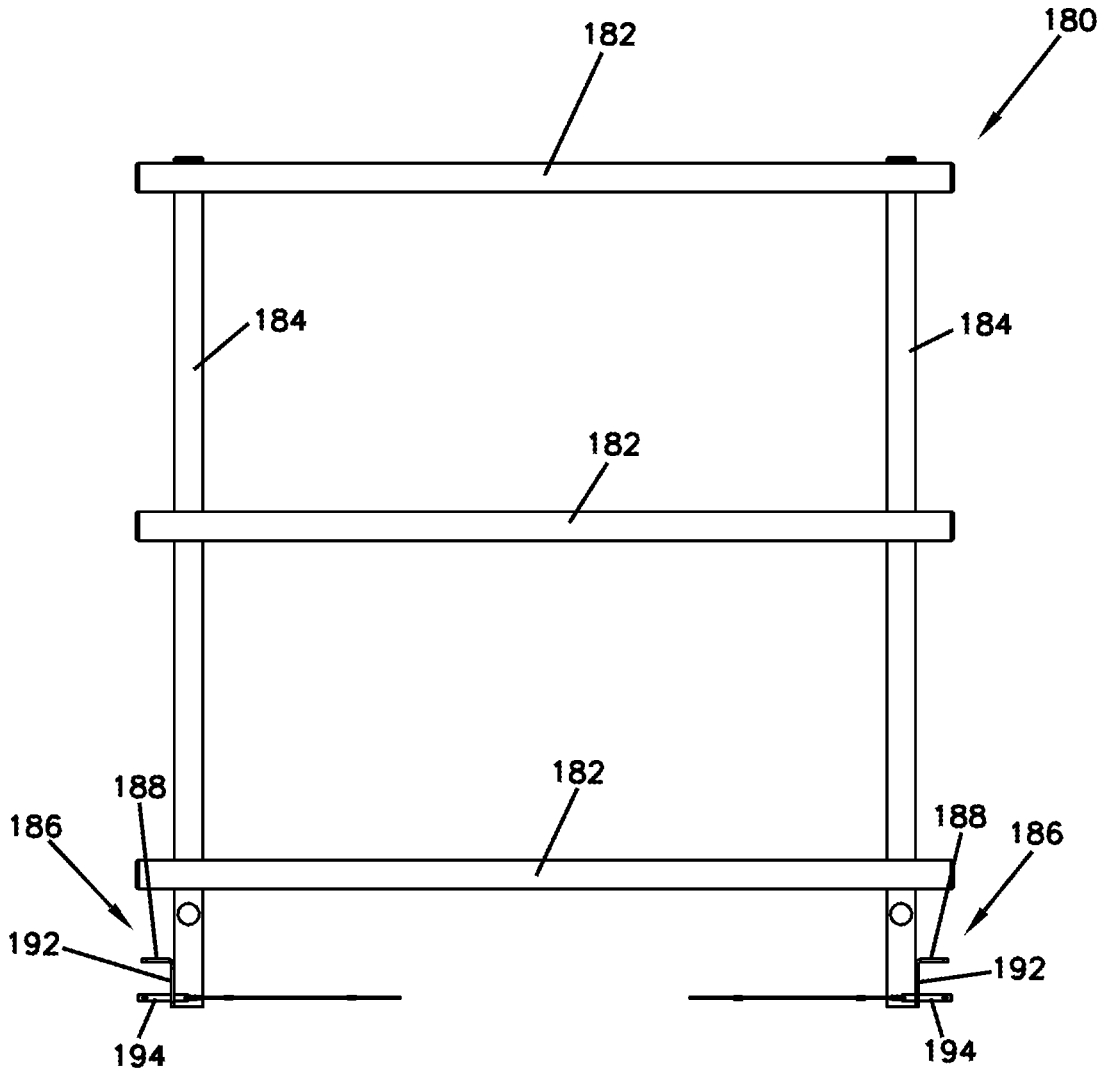
FIG. 38 is a front elevational view of the guardrail shown in FIG. 37.
Figure 39:
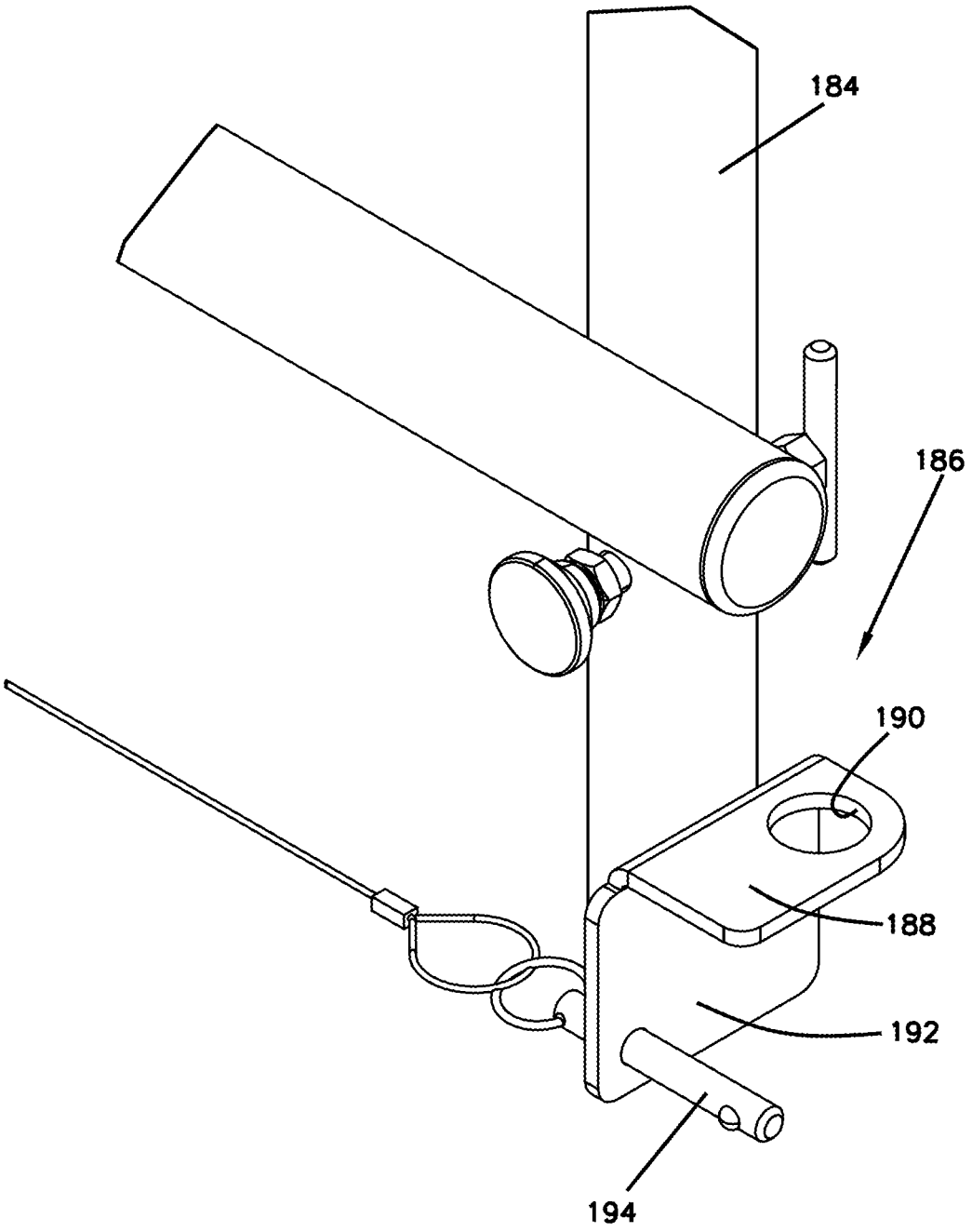
FIG. 39 is a detail view of the mounting assembly for the guardrail shown in FIG. 37.

Referring now to FIGS. 31 and 32, the height adjustment assembly (160) is shown. The height adjustment assembly (160) includes the pin (146) that is aligned with and extends upward above the frame columns (118) and into the through holes (136) of the decks (104) on the frames (102) or (202). The height adjustment assembly includes a bottom threaded bushing (162) and extends into the telescoping elements (120). A rod (164) threadably mounts into the bushing (162). A socket (166) mounts to the rod and supports the pin (146). The socket (166) includes a radially flange (168). The cylindrical corner portion (142D) of the pin connector assembly (140) is supported on the radial flange (168). Pin (146) and rod (164) are connected so that rotation of the pin (146) also rotates at the rod (164) which threadably rotates relative to the bushing (162). Alternatively, pin (146) and rod (164) may be formed as a single element. The threaded connection therefore provides axial movement of the socket (166) and pin (146) relative to the bushing (162) and column (118). Therefore, by rotating the pin, the socket (166) moves up or down and the height of the pin connector assembly (140) may be adjusted. Although a threaded relationship is shown, other configurations are possible that axially move the socket such as a worm gear or cam(s). Combined with the spaced apart adjustment holes in the telescoping elements (120), the stages (100), (200) and (300) may be adjusted to a proper height and more finely tuned to a proper height. Moreover, if the stage is on uneven ground or there are other irregularities, the height adjustment assembly may be changed so that a level surface is maintained across an elevated stage surface.

Figure 25:
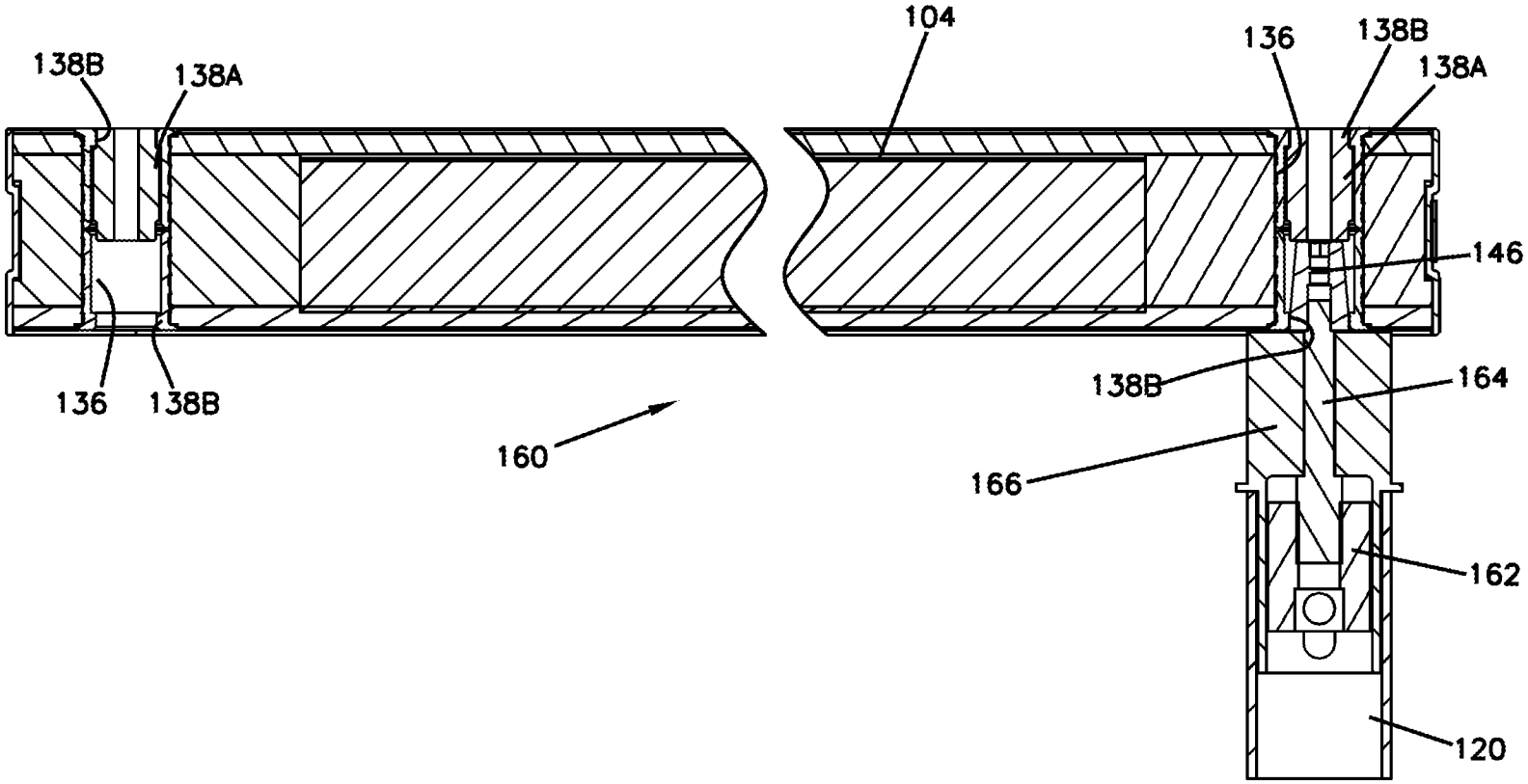
FIG. 25 is a side sectional detail view of the deck shown in FIG. 23.
Figure 26:
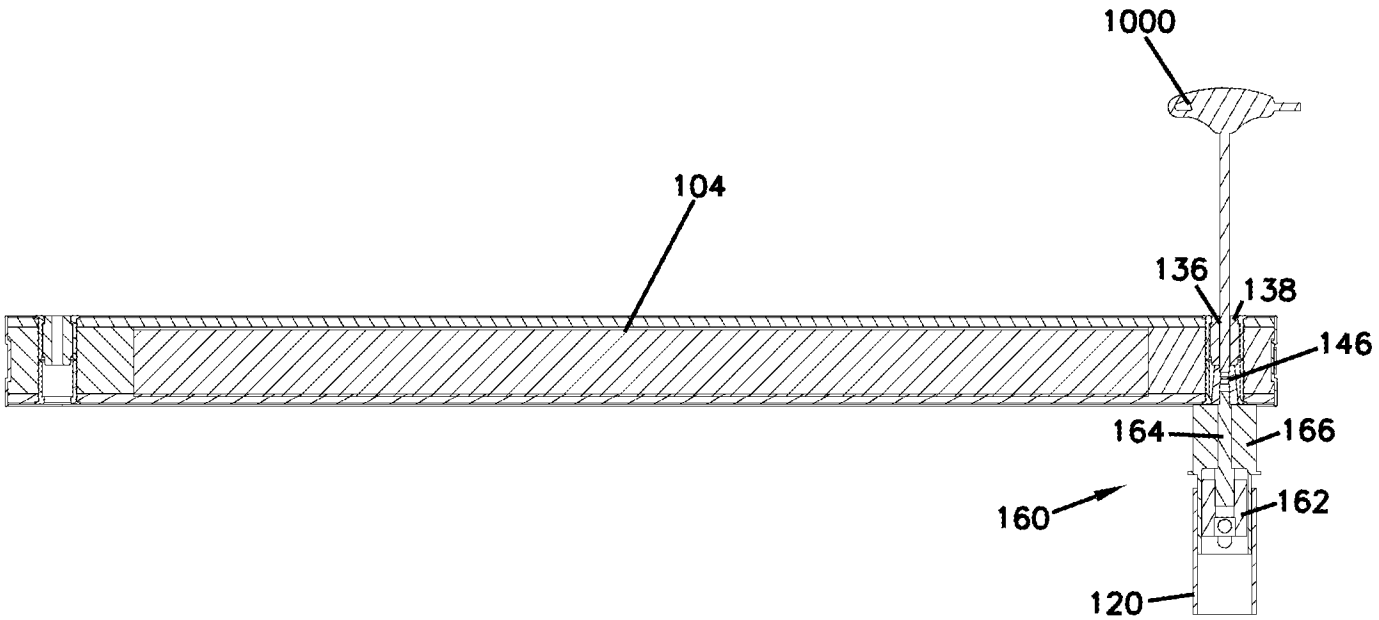
FIG. 26 is a side sectional view of the deck shown in FIG. 25 with the deck raised.
Figure 27:
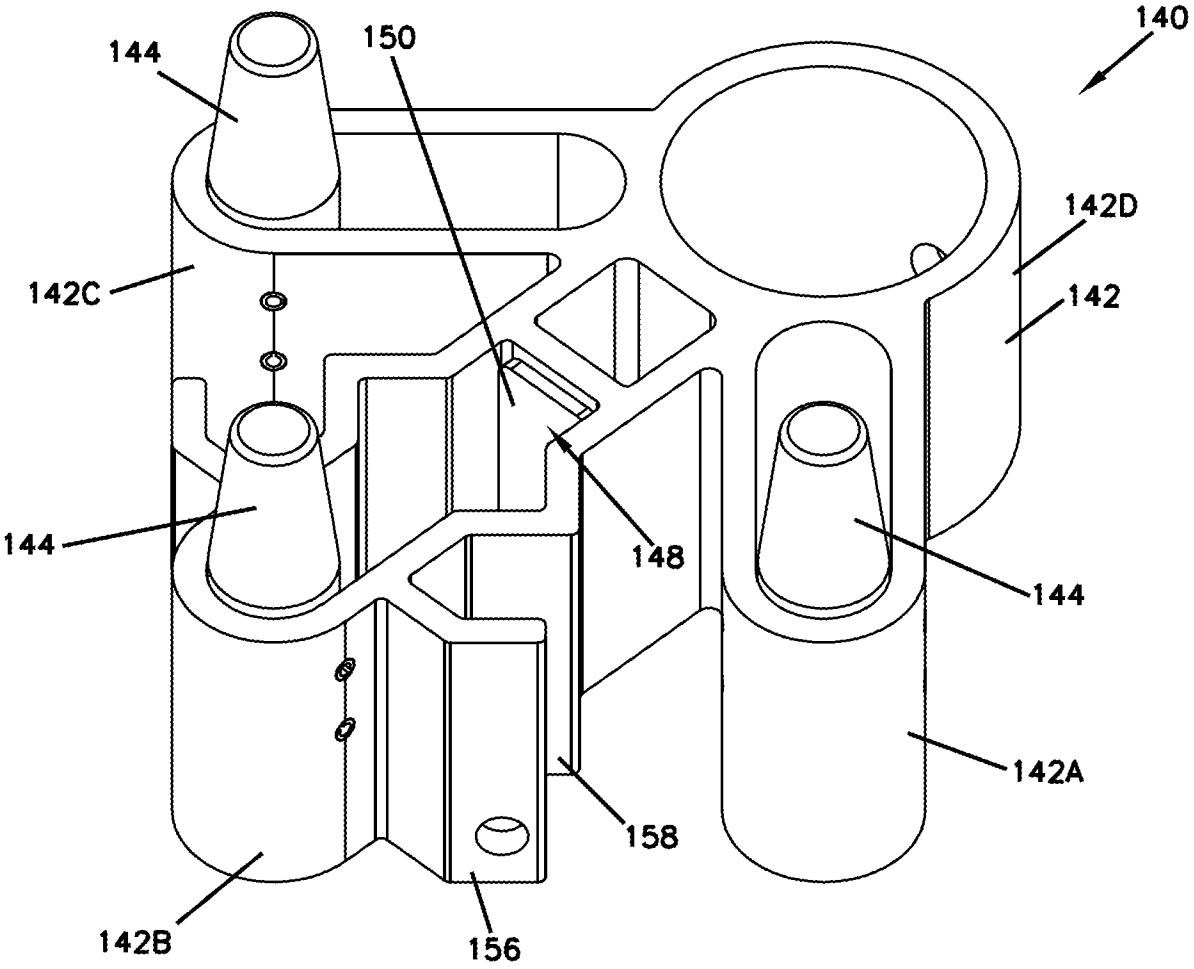
FIG. 27 is a perspective view of an adjustable pin connector assembly for the stage shown in FIG. 1, FIG. 11 or FIG. 21.
Figure 28:
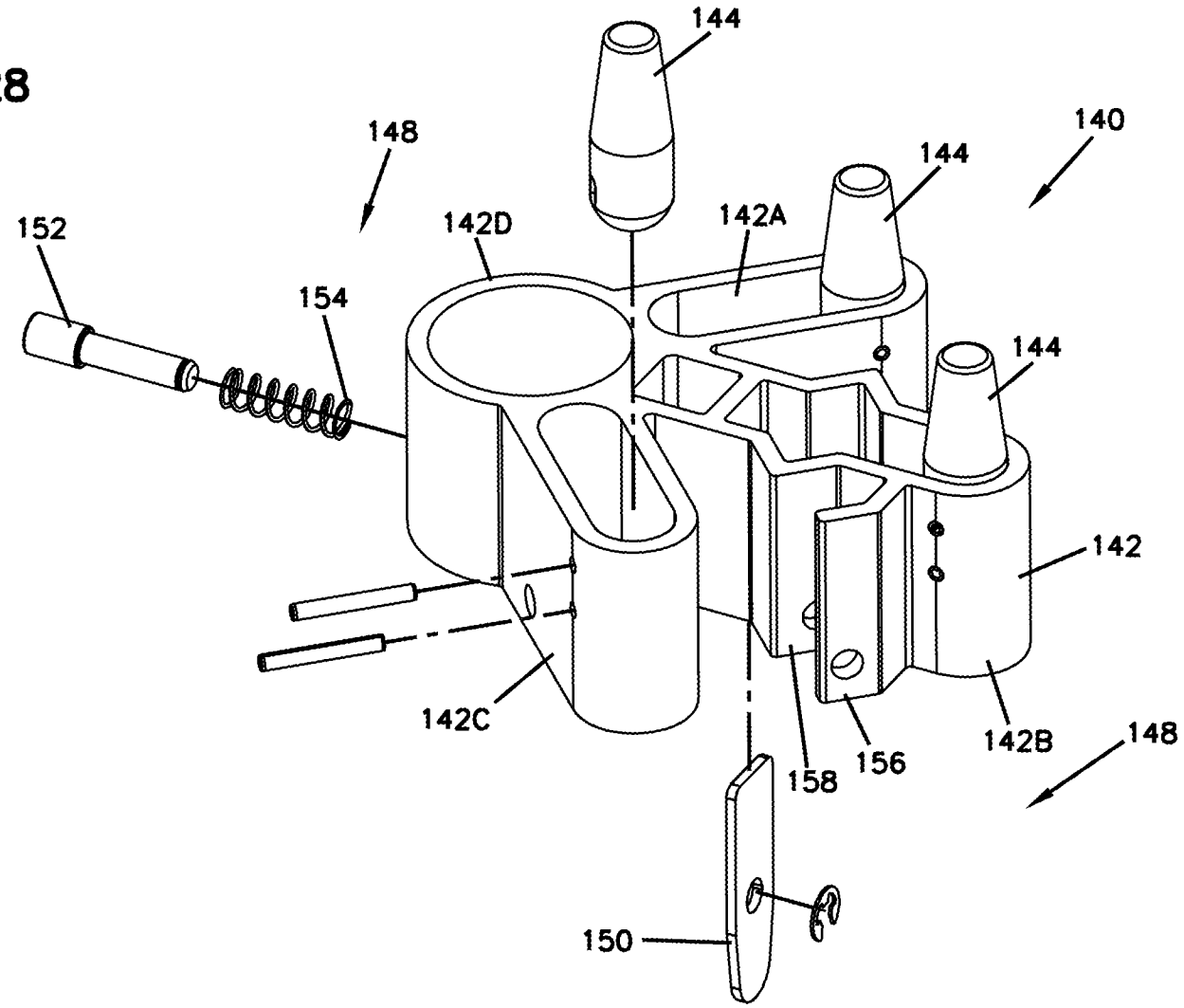
FIG. 28 is a partially exploded perspective view of the pin connector assembly shown in FIG. 27.
Figure 29:
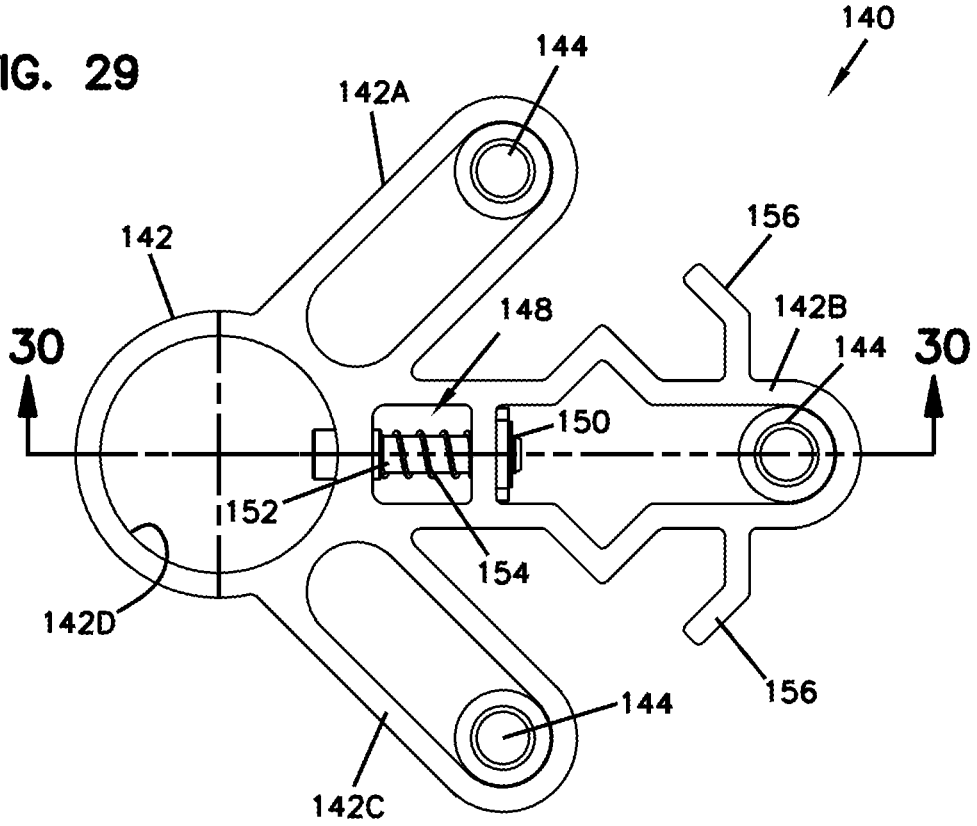
FIG. 29 is a top plan view of the pin connector assembly shown in FIG. 27.
Figure 30:
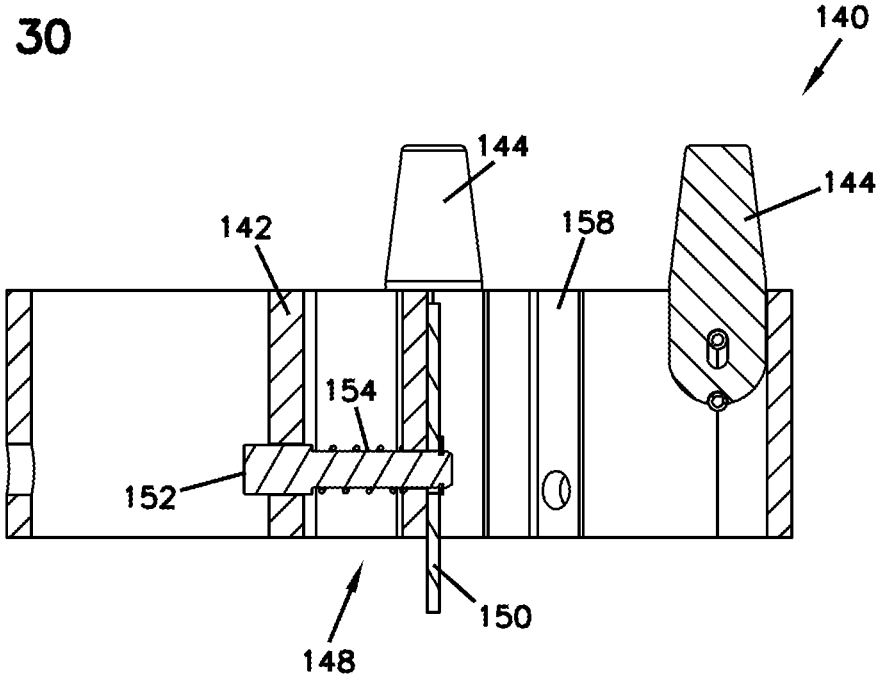
FIG. 30 is a sectional view taken along line 30-30 of FIG. 29.

Referring again to FIGS. 23-26, it can be appreciated that the pin (146) having an internal hex may be engaged through the top of the through hole (136) formed in the deck (104). A hex tool (1000) may simply be inserted into the complementary hex opening in the pin (146). As shown in FIG. 25, the height adjustment assembly (160) is at the lowest position. However, when the tool (1000) rotates the pin, the height adjustment assembly (160) raises the deck at the corner of the corresponding deck (104). The threads provide very fine height adjustment so that the proper level surface can be achieved. It can also be appreciated that unlike prior portable stage systems, the height adjustment is easily accessed and conducted from above the stage surface by workers.

Referring now to FIGS. 33-36, the stages (100), (200) and (300) may also utilize a second embodiment of a pin connector (170). The fixed pin connector (170) also includes rotatable pins (144) and a pin (146) above the frame columns. However, a housing (172) does not include the height adjustment assembly and does not include a release. It can be appreciated that removable pins (194) which may be connected to lanyards so that they are not lost or separated may be utilized for retaining the pin connectors to the stage. The fixed pin connector assembly (170) also includes the mounting surfaces (156) and (158) and may be utilized on some stages while the height adjustment is used on other ones of the stages depending upon the application.

Figure 40:
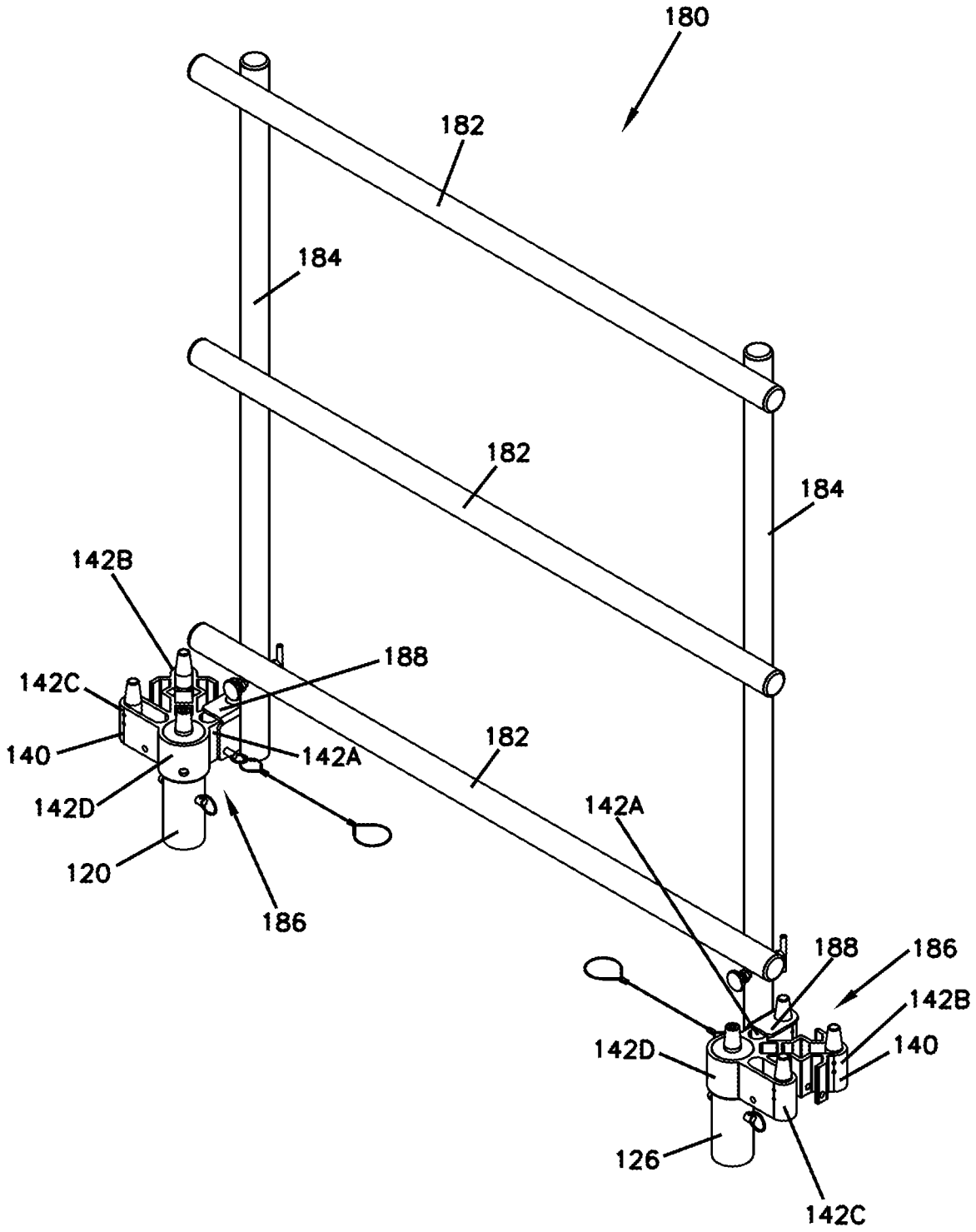
FIG. 40 is a perspective view of the guardrail shown in FIG. 27 mounted to pin connector assemblies.

Referring now to FIGS. 37-40, guardrails (180) are configured to be positioned along edges of an extended stage surface. The guardrail (180) includes cross members (182) and vertical members (184). Mounting brackets (186) are configured to mount to the pin connector assemblies (140) and/or (170). The mounting bracket (186) includes a horizontal flange (188), a pin-receiving portion (190) formed in the horizontal flange and a vertical engagement surface (192). A pin on a lanyard extends through the bracket (186) and engages the pin connector assemblies (140) or (170). The mounting brackets are configured so that the bracket engages the mounting surfaces (156) when mounted to the center arm portion (142B) or engage sides of the arm portions (142A) or (142C), as shown in FIG. 40. The pin receiving portion (190) fits over a rotating pin (144) to assure correct positioning and alignment. The connector pin (194) extends through the bracket (186) and backup surface (156) and (158). The vertical engagement surface abuts the corresponding mounting surfaces (156). With such a configuration, the rails (180) mount to the pin connector assemblies (140, 170) and do not require engagement with the deck. A sturdy support and strong connection are made to provide sufficient safety around the perimeter of an extended stage surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A portable stage comprising:

a deck having a planar first face and an opposite planar second face, a through-hole extending vertically through the deck between the first face and the second face;

a frame below the deck, the frame supporting the portable stage on a surface and having a vertical column extending to the surface;

a pin slidably and removably extending upward into the through-hole a fixed distance and having a top engagement portion configured to be engaged from above through the through-hole; and a height adjustment assembly mounted on the vertical column of the frame, the height adjustment assembly comprising a fixed bushing, an axially movable socket, and a rod and attached to an underside of the pin, the rod threadably engaging the bushing, wherein rotation of the pin and the attached rod relative to the socket and the bushing axially moves the socket relative to the bushing, the deck being removably supported on the socket, the height adjustment assembly raising the socket and the deck upon rotation of the pin in a first direction;

wherein the pin is insertable from below into the through-hole from either the first face or the second face of the deck and the deck is mountable onto the pin and wherein a portion of one of the first face or the second face of the deck proximate the through-hole faces downward and is resting on the height adjustment assembly with the other of the first face or the second face of the deck forming an upper surface.

2. A portable stage according to claim 1, wherein the height adjustment assembly lowers the deck upon rotation of the pin in a second direction.

3. A portable stage according to claim 1, wherein the top engagement portion comprises a tool engagement recess at an upper surface of the pin and configured for engagement from above by a complementary tool extending through the through-hole.

4. A portable stage according to claim 1, further comprising a sliding insert in the through-hole engaging a top of the pin and defining a passage aligned with a top of the pin.

5. A portable stage according to claim 4, further comprising an end cap at each end of the through-hole proximate the first face and the second face, the end caps retaining the sleeve in the through-hole, the end cap having a center opening.

6. A portable stage according to claim 1, further comprising a sleeve slidably retained in the through-hole between a first position proximate the first face and a second position proximate the second face, the sleeve engaging a top of the pin.

7. A portable stage according to claim 1, wherein the stage comprises a plurality of the decks and wherein the height adjustment assembly comprises a plurality of pins configured for supporting the plurality of the decks.

8. A portable stage according to claim 1, wherein the upper surface of the deck is unobstructed.

9. A portable stage comprising:

a deck having a through-hole extending vertically through the deck;

a frame below the deck, the frame supporting the portable stage on a surface and having a vertical column extending to the surface;

a pin removably extending into the through-hole and having a top engagement portion configured to be engaged from above through the through-hole; and a height adjustment assembly mounted on the vertical column of the frame and attached to the pin, the deck being removably supported on the height adjustment assembly, the height adjustment assembly raising the deck upon rotation of the pin in a first direction;

a pin connector assembly, the pin connector assembly including a plurality of further pins, the further pins being spaced and configured for extending into a corresponding through-hole in a corresponding bridging deck;

wherein the further pins are rotatably mounted to move between a lowered position in which the further pins extend substantially horizontally and a raised position in which the further pins extend vertically, on arms extending from a housing and wherein the housing is rotatably mounted for positioning one or more of the arms below the deck.

10. A portable stage comprising:

a deck having a through-hole extending vertically through the deck;

a frame below the deck, the frame supporting the portable stage on a surface and having a vertical column extending to the surface;

a pin removably extending into the through-hole and having a top engagement portion configured to be engaged from above through the through-hole; and a height adjustment assembly mounted on the vertical column of the frame and attached to the pin, the deck being removably supported on the height adjustment assembly, the height adjustment assembly raising the deck upon rotation of the pin in a first direction;

a pin connector assembly, the pin connector assembly including three arms extending from the housing, each of the arms having a further pin mounted thereon; the further pins being spaced to extend into through-holes of further decks and support a corner of the further decks;

wherein the further pins are rotatably mounted on the arms to move between a lowered position in which the further pins extend substantially horizontally and a raised position in which the further pins extend vertically and wherein the housing and each of the pins are rotatably mounted for positioning one or more of the arms below the deck;

wherein the further pins are rotatably mounted on the arms to move between a lowered position and a raised position and wherein the housing and each of the pins are rotatably mounted for positioning one or more of the arms below the deck.

11. A mobile stage comprising:

a frame including a vertical column;

a height adjustment assembly mounted on an upper portion of the vertical column, the height adjustment assembly comprising a fixed bushing, an axially movable socket, and a rod attached, the rod threadably engaging the bushing;

an upward extending pin mounted on the to the rod of the height adjustment assembly and rotating with the rod, wherein rotation of the pin and the attached rod relative to the socket and the bushing axially moves the socket relative to the bushing;

a deck having a first face and an opposite second face with a through-hole extending vertically through the deck from the first face to the second face; the deck being supported on the height adjustment assembly with the pin removably slidably extending into the through-hole;

wherein the pin is insertable into the through-hole a fixed distance from either the first face or the second face of the deck and the deck is mountable onto the pin and wherein a portion of one of the first face or the second face of the deck proximate the through-hole faces downward and is resting on the height adjustment assembly with the other of the first face or the second face of the deck forming an upper surface.

12. A mobile stage according to claim 11, the height adjustment assembly being raised upon rotation of the pin in a first direction and lowering upon rotation of the pin in a second direction.

13. A mobile stage according to claim 11, further comprising a sleeve slidably retained in the through-hole and engaging a portion of the pin and having a passage extending through the sleeve.

14. A mobile stage according to claim 13, wherein the sleeve defines a recessed portion having a diameter greater than the passage, the recessed portion engaging an upper portion of the pin.

15. A portable stage comprising:

a deck having a through-hole extending vertically through the deck;

a frame below the deck, the frame supporting the portable stage on a surface and having a vertical column extending to the surface;

a pin removably extending into the through-hole and having a top engagement portion configured to be engaged from above through the through-hole; and a height adjustment assembly mounted on the vertical column of the frame and attached to the pin, the deck being removably supported on the height adjustment assembly, the height adjustment assembly raising the deck upon rotation of the pin in a first direction;

a pin connector assembly, the pin connector assembly including a plurality of arms extending from the housing, each of the arms having a further pin mounted thereon; the further pins being spaced to extend into through-holes of further decks and support a corner of the further decks;

wherein the further pins are rotatably mounted on the arms to move between a lowered position and a raised position and wherein the housing and each of the pins are rotatably mounted for positioning one or more of the arms below the deck.

* * * * *